US011719484B2

(12) United States Patent
Ko et al.

(10) Patent No.: US 11,719,484 B2
(45) Date of Patent: Aug. 8, 2023

(54) REFRIGERATOR

(71) Applicant: Samsung Electronics Co., Ltd., Suwon-si (KR)

(72) Inventors: Kihun Ko, Suwon-si (KR); Jeongman Nam, Suwon-si (KR); Hyunghee Moon, Suwon-si (KR); Younggon Park, Suwon-si (KR); Jungkeun Park, Suwon-si (KR); Jungyong Lee, Suwon-si (KR); Taeyun Jung, Suwon-si (KR); Shanghun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 218 days.

(21) Appl. No.: 17/085,400

(22) Filed: Oct. 30, 2020

(65) Prior Publication Data

US 2021/0131717 A1 May 6, 2021

(30) Foreign Application Priority Data

Nov. 1, 2019 (KR) ..... 10-2019-0138322
Aug. 21, 2020 (KR) ..... 10-2020-0105234

(51) Int. Cl.
*F25D 17/06* (2006.01)

(52) U.S. Cl.
CPC ..... *F25D 17/065* (2013.01)

(58) Field of Classification Search
CPC ..... F25D 17/08; F25D 19/02; F25D 21/08; F25D 21/14; F25D 17/065; F25B 39/04
See application file for complete search history.

(56) References Cited

U.S. PATENT DOCUMENTS 3,116,641 A 1/1964 King
5,347,827 A * 9/1994 Rudick ..... A47F 3/0408 62/255
5,875,645 A * 3/1999 Dunnigan ..... G07F 9/105 62/302

(Continued)

FOREIGN PATENT DOCUMENTS

ES 2 115 433 6/1998
JP 6-159911 A 6/1994

(Continued)

OTHER PUBLICATIONS

International Search Report dated Feb. 10, 2021 in International Patent Application No. PCT/KR2020/015064.

(Continued)

*Primary Examiner* — Elizabeth J Martin
(74) *Attorney, Agent, or Firm* — Staas & Halsey LLP

(57) ABSTRACT

A refrigerator including a cabinet including an insulator provided between an inner case and an outer case, a cold air duct embedded in the insulator to circulate cold air through the storage compartment, a cooling module mounting unit provided at a lower portion of the cabinet, and a cooling module including a module body in which an evaporator, a condenser, a compressor, and a cooling fan are installed and having an accommodating portion to accommodate the evaporator in a lying state, the cooling module being provided with a connection opening communicating with the cold air duct when mounted on the cooling module mounting unit.

15 Claims, 28 Drawing Sheets

(56) References Cited

U.S. PATENT DOCUMENTS

| | | | | |
|---|---|---|---|---|
| 2011/0179817 | A1* | 7/2011 | Andersson | F25D 19/00 62/288 |
| 2015/0272345 | A1 | 10/2015 | Bhatia et al. | |
| 2020/0318871 | A1* | 10/2020 | Sung | F25D 19/00 |

FOREIGN PATENT DOCUMENTS

| | | |
|---|---|---|
| JP | 7-41370 | 7/1995 |
| JP | 4190436 | 12/2008 |
| JP | 4934446 | 5/2012 |
| KR | 10-2000-0031061 | 6/2000 |
| KR | 20-0297297 | 12/2002 |
| KR | 20-0336427 | 12/2003 |
| KR | 10-0950846 | 4/2010 |
| KR | 10-2010-0092277 | 8/2010 |
| KR | 10-2011-0021923 A | 3/2011 |
| KR | 10-1245263 | 4/2013 |
| KR | 10-1670086 | 11/2016 |
| KR | 10-1829222 | 2/2018 |
| KR | 10-1872607 | 6/2018 |
| KR | 10-2019-0033881 | 4/2019 |
| WO | WO 2019/059651 A1 | 3/2019 |

OTHER PUBLICATIONS

European Search Report issued in European Application No. 20883472.1 dated Sep. 15, 2022.

European Search Report dated Dec. 19, 2022 issued in European Application No. EP 20 88 3472.

* cited by examiner

REFRIGERATOR

CROSS-REFERENCE TO RELATED APPLICATIONS

This application is based on and claims priority under 35 U.S.C. § 119 to Korean Patent Application Nos. 10-2019-0138322, filed on Nov. 1, 2019, and 10-2020-0105234, filed on Aug. 21, 2020, in the Korean Intellectual Property Office, the disclosures of which are incorporated by reference herein in their entireties.

BACKGROUND

1. Field

The disclosure relates to a refrigerator, and more particularly, to a refrigerator having a detachable cold air supply module.

2. Description of the Related Art

Generally, a refrigerator is an appliance that keeps food fresh by including a main body provided with a storage compartment therein and a cold air supply system for supplying cold air to the storage compartment. The storage compartment includes a refrigerating chamber that is maintained at temperature of about 0 degrees Celsius to 5 degrees Celsius to keep food refrigerated, and a freezing chamber that is maintained at temperature of about 0 degrees Celsius to −30 degrees Celsius to keep food frozen.

An insulator is provided in a cabinet forming a storage compartment in a refrigerator, and a machine room is formed outside the cabinet. Among components of a cold air supply system, a compressor and a condenser are arranged in the machine room formed outside the cabinet, and an evaporator is arranged in the storage compartment formed inside the cabinet, and refrigerant pipes through which a refrigerant moves are disposed to pass through the insulator.

Accordingly, in the case of testing the cooling performance of a cold air supply system in a refrigerator, the cooling performance test may be performed only after all components of the cold air supply system are installed in a cabinet. In addition, in the case of maintaining the cold air supply system, the cabinet needs to be disassembled.

SUMMARY

It is an aspect of the disclosure to provide a refrigerator in which a cold air supply system may be easily maintained.

It is another aspect of the disclosure to provide a refrigerator in which the loss of cold air in a storage compartment may be prevented during maintenance of a cold air supply system.

It is another aspect of the disclosure to provide a refrigerator in which productivity may be improved by cost reduction due to a simplified structure resulting from a reduction in the number of parts.

It is another aspect of the disclosure to provide a refrigerator in which the transmission of noise and vibrations from a cold air supply system into the refrigerator may be reduced.

Additional aspects of the disclosure will be set forth in part in the description which follows and, in part, will be obvious from the description, or may be learned by practice of the disclosure.

In accordance with an aspect of the disclosure, a refrigerator includes a cabinet including an inner case, an outer case, and an insulator provided between the inner case and the outer case, a cold air duct embedded in the insulator to circulate cold air through the storage compartment, a cooling module mounting unit provided at a lower portion of the cabinet, and a cooling module including a module body in which an evaporator, a condenser, a compressor, and a cooling fan are installed and having an accommodating portion to accommodate the evaporator in a lying state, the cooling module being provided with a connection opening communicating with the cold air duct when mounted on the cooling module mounting unit.

The module body may be integrally provided with a collecting portion in which condensed water is collected partitioned by a partition wall forming the accommodating portion, the accommodating portion and the collecting portion may be in communication with each other through a drain hole formed on the partition wall, and a bottom of the accommodating portion may be formed to be inclined downward toward the collecting portion.

The accommodating portion and the collecting portion may be configured as one body in the module body and may be arranged adjacent to each other in a front-rear direction of the module body, and the condenser may be positioned in the collecting portion.

The accommodating portion may be divided into a first region in which the evaporator is positioned and a second region in which the cooling fan is positioned, and the refrigerator may further include an evaporator cover covering an upper portion of the first region and having a cold air recovery hole formed thereon.

The refrigerator may further include a module cover coupled to cover an upper portion of the module body and having a connection opening formed thereon wherein the connection opening may include a first connection opening corresponding to the cold air recovery hole and a second connection opening corresponding to an outlet of the cooling fan.

The cold air duct may include a recovery duct to recover cold air in the storage compartment and a supply duct to supply cold air to the storage compartment, the first connection opening may be connected to the recovery duct, and the second connection opening may be connected to the supply duct.

Guide rails configured to guide sliding mounting of the cooling module may be installed on opposite sides of the cooling module mounting unit.

The cooling module may further include a defrost heater disposed below the evaporator.

An electrical module configured to control the cooling module may be integrally provided in the cooling module.

In accordance with another aspect of the disclosure, a refrigerator includes a cabinet including an inner case forming a plurality of storage compartments therein, an outer case, and an insulator provided between the inner case and the outer case, a cold air duct embedded in the insulator to circulate cold air through the plurality of storage compartments, a cooling module mounting unit provided at a lower portion of the cabinet, and a cooling module including a module body in which a first evaporator, a second evaporator, a condenser, a compressor, a first cooling fan, a second cooling fan, and a collecting portion are installed and having a first accommodating portion and a second accommodating portion to accommodate the first evaporator and the second evaporator in lying states, respectively, the cooling module being provided with a connection opening communicating with the cold air duct when mounted on the cooling module mounting unit.

The module body may be integrally provided with a collecting portion in which condensed water is collected partitioned by a partition wall forming the first accommodating portion and the second accommodating portion, the partition wall may be provided with a first drain hole to communicate the first accommodating portion and the first collecting portion and a second drain hole to communicate the second accommodating portion and the second collecting portion, and bottoms of the first accommodating portion and second accommodating portion may be formed to be inclined downward toward the corresponding first drain hole and second drain hole, respectively.

The first accommodating portion and the second accommodating portion may be arranged side by side at the front of the module body in a state of being partitioned from each other, and the collecting portion in which the condenser is positioned and a compressor mounting portion in which the compressor is mounted may be arranged side by side at the rear of the module body in a state of being partitioned from each other by a fence.

The first evaporator and the first cooling fan may be accommodated in the first accommodating portion, and the second evaporator and the second cooling fan may be accommodated in the second accommodating portion.

Guide rails configured to guide sliding mounting of the cooling module may be installed on opposite sides of the cooling module mounting unit, and the cooling module may enter from the rear of the cooling module mounting unit and may move forward.

The first accommodating portion may be in communication with at least two of the plurality of storage compartments by the cold air duct, and the second accommodating portion may be in communication with one of the plurality of storage compartments by the cold air duct.

The first evaporator may be provided relatively larger than the second evaporator.

The plurality of storage compartments may include a first storage compartment, a second storage compartment, and a third storage compartment, and the cold air duct may include a first supply duct configured to supply cold air generated in the first accommodating portion to the first storage compartment and the second storage compartment, a first recovery duct configured to recover cold air in the first storage compartment and the second storage compartment, a second supply duct configured to supply cold air generated in the second accommodating portion to the third storage compartment, and a second recovery duct configured to recover cold air in the third storage compartment.

On the outer case forming the ceiling of the cooling module mounting unit, a first cold air inlet corresponding to an outlet of the first cooling fan, a second cold air inlet corresponding to an outlet of the second cooling fan, a first cold air outlet corresponding to a region in the vicinity of the first evaporator, and a second cold air outlet corresponding to a region in the vicinity of the second evaporator may be formed.

One side of the first supply duct may be connected to the first cold air inlet and the other side of the first supply duct may be in communication with the first storage compartment and the second storage compartment, one side of the second supply duct may be connected to the second cold air inlet and the other side of the second supply duct may be in communication with the third storage compartment, one side of the first recovery duct may be connected to the first cold air outlet and the other side of the first recovery duct may be in communication with lower regions of the first storage compartment and second storage compartment, and one side of the second recovery duct may be connected to the second cold air outlet and the other side of the second recovery duct may be in communication with a lower region of the third storage compartment.

The cooling module may further include a first evaporator cover and a second evaporator cover configured to respectively cover upper portions of the first evaporator and the second evaporator and having a first cold air recovery hole and a second cold air recovery hole corresponding to the first cold air outlet and the second cold air outlet, respectively, a module cover configured to cover an upper portion of the module body and having a pair of first connection openings corresponding to the first cold air recovery hole and the second cold air recovery hole, respectively, and a pair of second connection openings corresponding to the first cold air inlet and the second cold air inlet, respectively, and a defrost heater configured to defrost the first evaporator and the second evaporator.

In accordance with another aspect of the disclosure, a refrigerator includes a cabinet including an inner case forming a storage compartment, an outer case, and an insulator provided between the inner case and the outer case, a cooling module mounting unit provided at a lower portion of the cabinet, a cooling module including a module body in which an evaporator, a condenser, a compressor, and a cooling fan are installed and having an accommodating portion to accommodate the evaporator in a lying state, a connection part including an outer case bottom opening formed at an outer case bottom and corresponding to the accommodating portion, and an inner case bottom opening formed at an inner case bottom and corresponding to the outer case bottom opening, the inner case bottom opening and the outer case bottom opening being arranged vertically, and a connection cover configured to open and close the inner case bottom opening, wherein the cooling module is in communication with the storage compartment through the connection part when mounted on the cooling module mounting unit.

The connection cover may include a connection opening through which the connection part is in communication with the storage compartment in a state in which the connection cover closes the inner case bottom opening.

The refrigerator may further include an access neck formed along a circumference of the outer case bottom opening and protruding from the outer case bottom toward the inner case bottom opening, and a neck flange formed at one end of the access neck to be in contact with the inner case bottom, wherein the connection part may be formed inside the access neck.

The refrigerator may further include a duct module seated on the connection part and having a shape corresponding to the connection part.

The duct module may include a duct module body seated on the connection part, an insulator filled in the duct module body, and a cold air recovery duct passing through the duct module body and the insulator, the connection cover may cover an upper end of the insulator and may be coupled to an upper end of the duct module body, and an opening formed at one end of the cold air recovery duct may be in communication with the accommodating portion and an opening formed at the other end of the cold air recovery duct may be in communication with the connection opening of the connection cover The connection cover may be provided to be caught on the inner case bottom positioned at an edge of the inner case bottom opening.

An area in which an upper edge of the connection cover is formed may be larger than an area in which an edge of the inner case bottom opening is formed.

The module body may further include a protrusion formed along an upper edge of the module body.

The outer case bottom may include a depression formed on a portion of the outer case bottom facing the cooling module mounting unit and corresponding to a shape of the protrusion.

When the cooling module is mounted on the cooling module mounting unit, the protrusion and the depression may be in close contact with each other to block the outflow of cold air near the upper edge of the module body.

The cooling module may further include a collecting portion in which condensed water is collected and the condenser is disposed, the collecting portion being arranged adjacent to the accommodating portion in a front-rear direction of the module body with a partition wall forming the accommodating portion therebetween, and the accommodating portion and the collecting portion may be in communication with each other through a drain hole formed on the accommodating portion and a drain pipe connected to the drain hole and passing through the partition wall, and the drain pipe and a bottom of the accommodating portion may be provided to be inclined downward toward the collecting portion.

The cooling module may further include a drain cap rotatably coupled to one end of the drain pipe, and the drain cap may be configured to open and close the one end of the drain pipe by an own weight thereof.

The cooling module may further include an electrical module configured to control the cooling module, the compressor and the condenser may be arranged left and right at the rear of the module body with a condensing fan therebetween, and an electrical module housing of the electrical module may be disposed above the compressor and below the outer case bottom.

The cooling module may further include a support bracket protruding from the module body toward the compressor, and a bottom of the electrical module housing may be supported by an upper end of the condensing fan and the support bracket.

The cooling module may further include a module rear cover configured to cover the condenser, the condensing fan, the compressor, and the electrical module and forming an outer appearance of the refrigerator together with a rear wall of the outer case, the module rear cover may include a vent hole in a region corresponding to the condenser or the compressor, the condenser may include a plurality of cooling fins, and each of the plurality of cooling fins may be arranged in parallel with a flow direction of an airflow flowing into the condensing fan by being introduced into the vent hole.

The plurality of cooling fins may be arranged in a C shape including a short side adjacent to the condensing fan and a long side adjacent to the module rear cover.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

Like reference numbers or signs in the various figures of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

The terms "forward," "rearward," "upper portion," "lower portion," "upward" and "downward" used in the following description are defined with reference to the drawings, and the shape and position of each component are not limited by these terms.

Hereinafter, embodiments of the disclosure will be described in detail with reference to the accompanying drawings.

Figure 1:
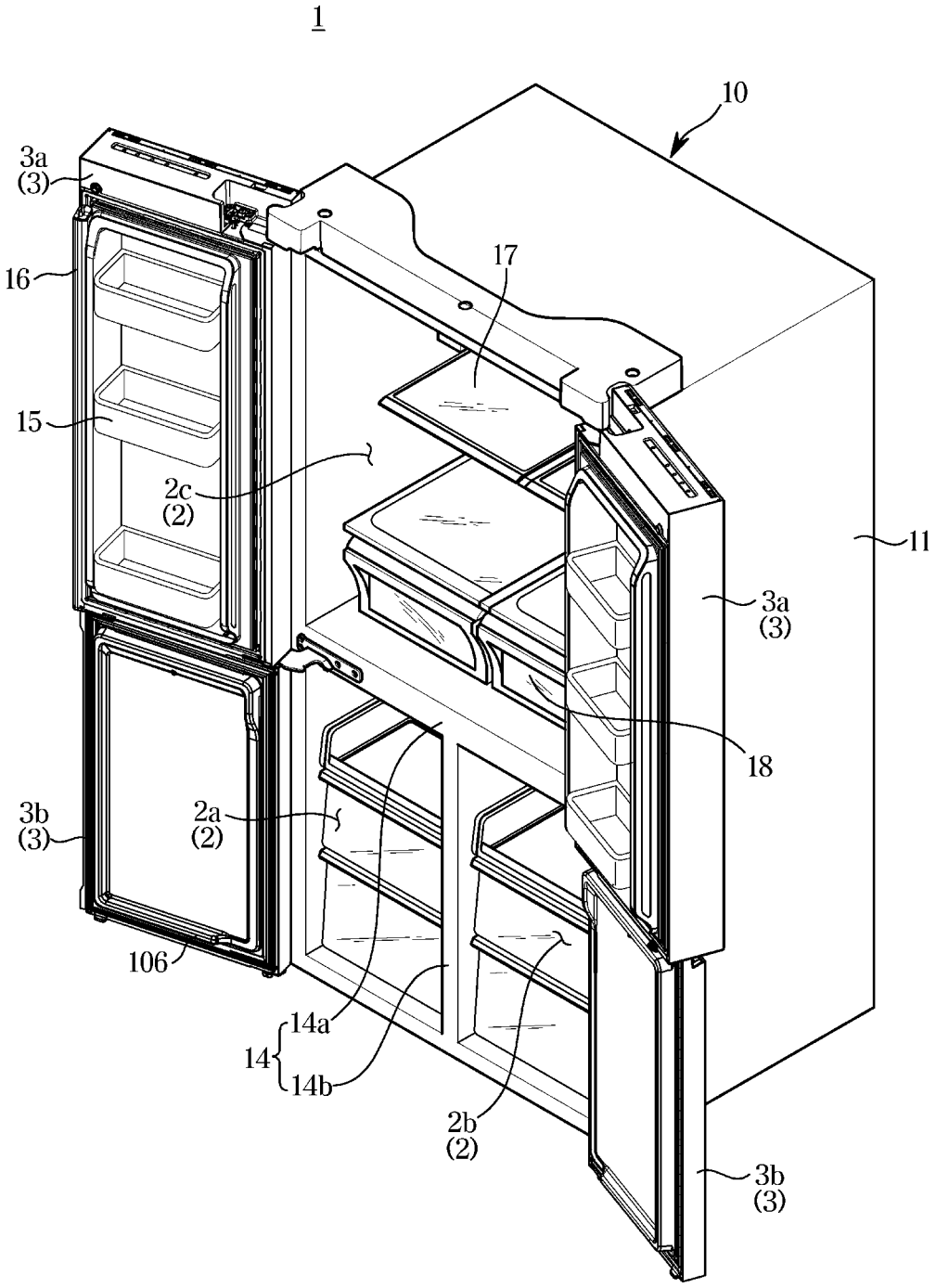
FIG. 1 is a perspective view of a refrigerator according to an embodiment of the disclosure.
Figure 2:
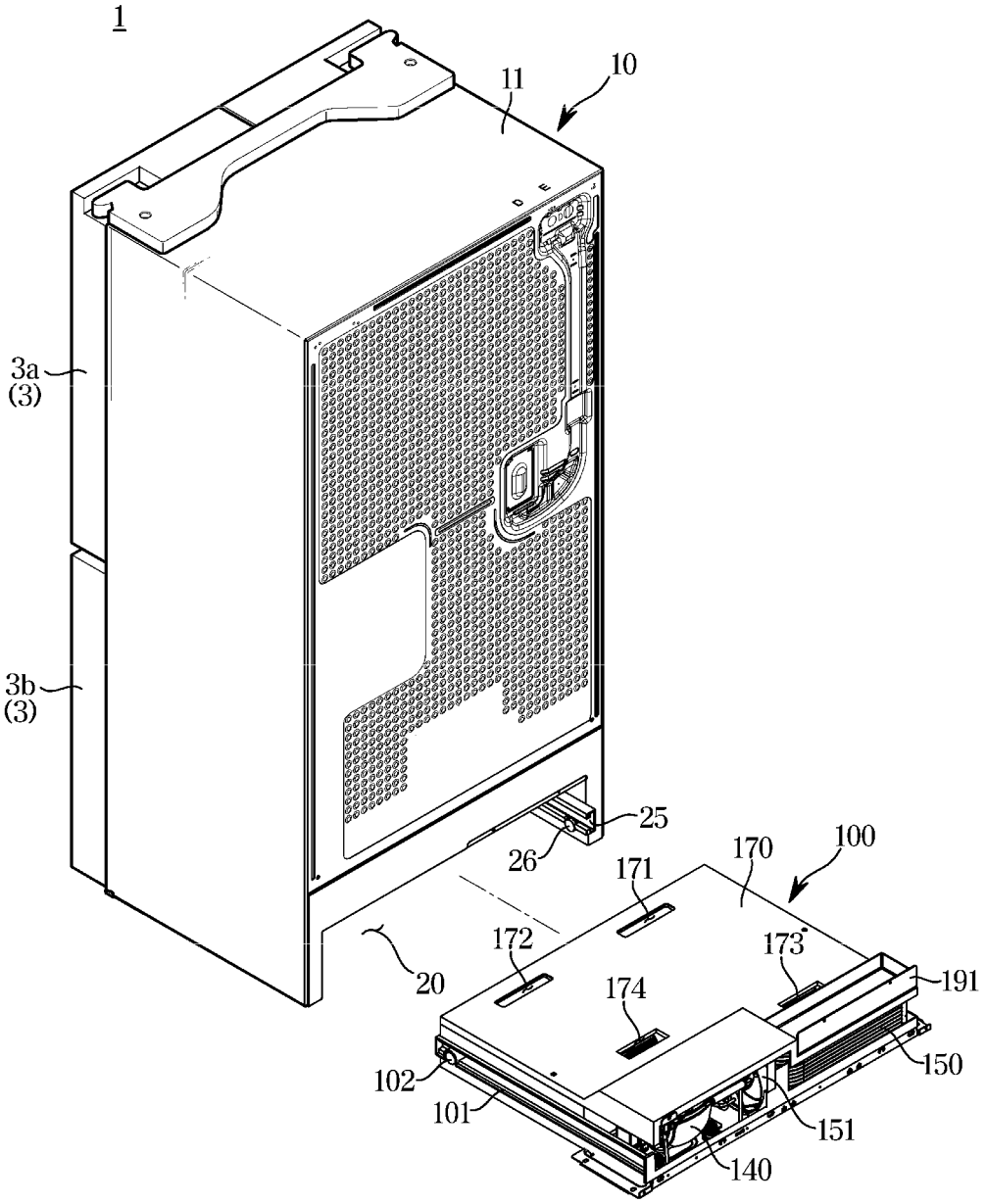
FIG. 2 is a perspective view illustrating a state in which a cooling module is separated from a cabinet in the refrigerator according to an embodiment of the disclosure.
Figure 3:
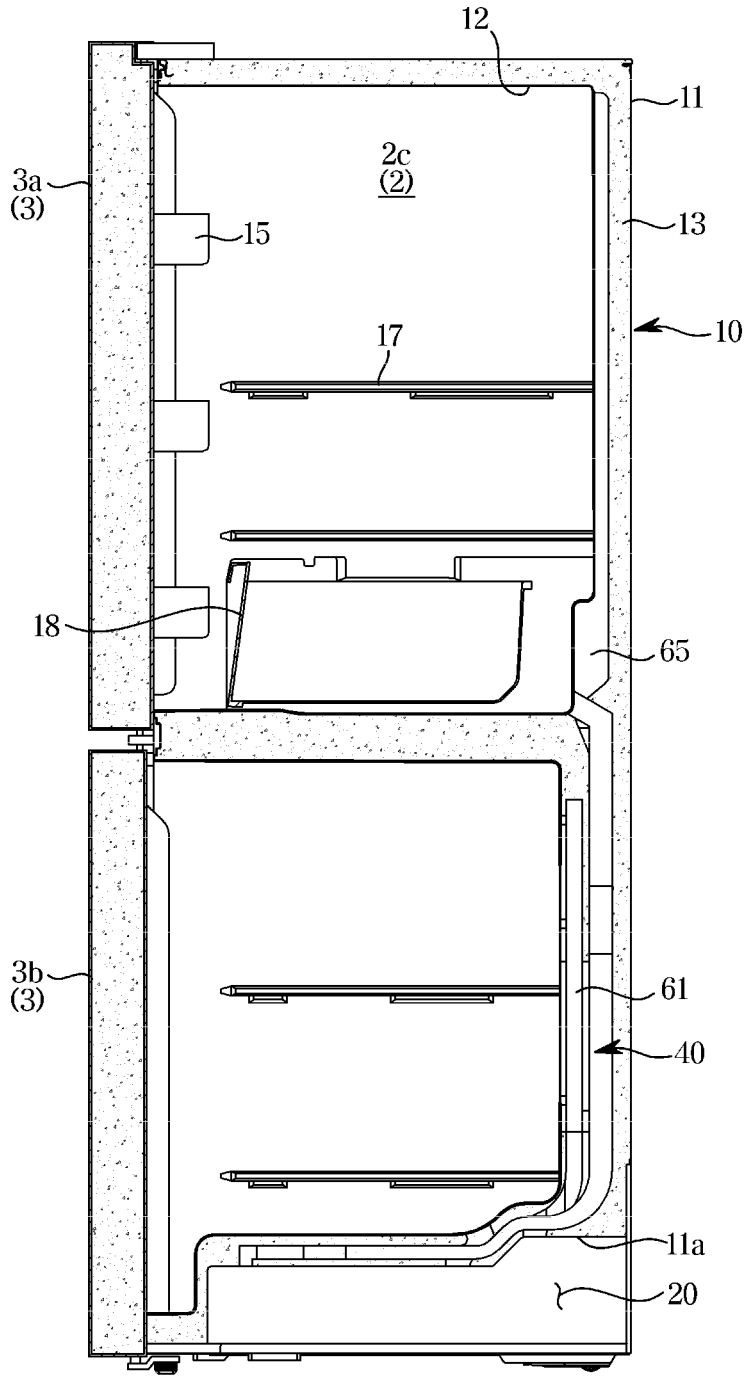
FIG. 3 is a cross-sectional view of the refrigerator according to an embodiment of the disclosure.
Figure 4:
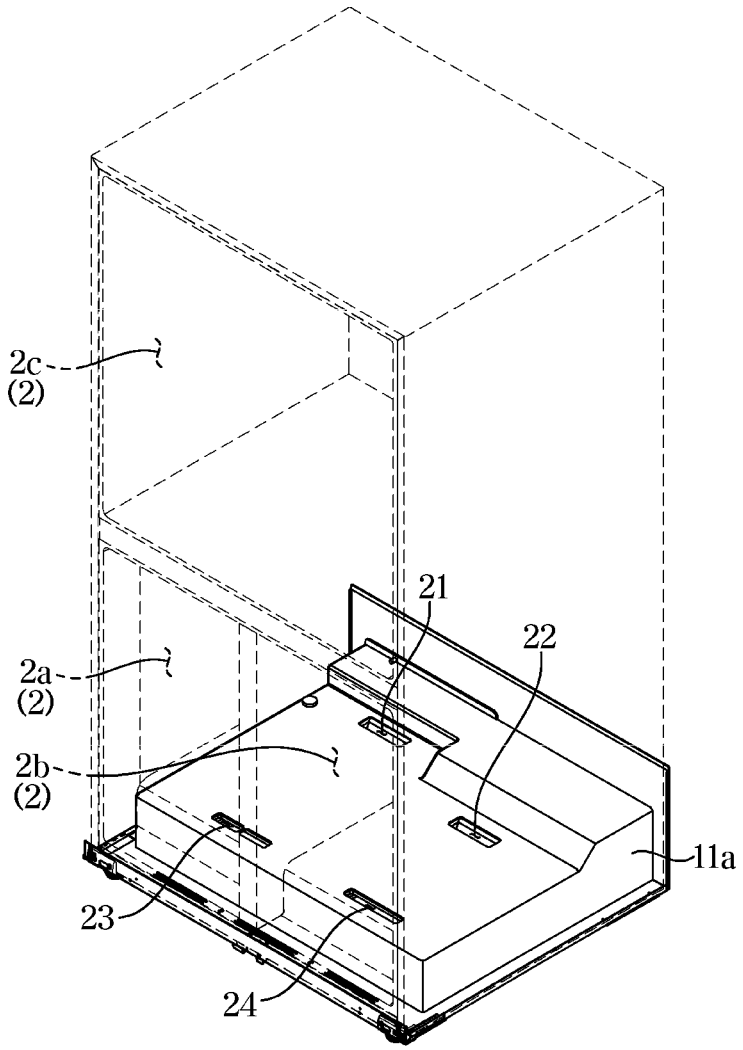
FIG. 4 is a perspective view of an outer case forming a cooling module mounting unit according to an embodiment of the disclosure.

FIG. 1 is a perspective view of a refrigerator according to an embodiment of the disclosure, FIG. 2 is a perspective view illustrating a state in which a cooling module is separated from a cabinet in the refrigerator according to an embodiment of the disclosure, FIG. 3 is a cross-sectional view of the refrigerator according to an embodiment of the disclosure, and FIG. 4 is a perspective view of an outer case forming a cooling module mounting unit according to an embodiment of the disclosure.

Referring to FIGS. 1 to 4, a refrigerator 1 may include a cabinet 10 forming a storage compartment 2, a door 3 to open and close the storage compartment 2, and a cooling module 100 detachably coupled to the cabinet 10 to supply cold air to the storage compartment 2.

The cabinet 10 may include an outer case 11 forming an outer appearance thereof, an inner case 12 coupled to an inner side of the outer case 11 to form a plurality of the storage compartments 2, insulators 13 placed between the outer case 11 and inner case 12 to insulate the storage compartments 2, and a cold air duct 40 embedded in the insulator 13 to circulate cold air through the cooling module 100 and the storage compartments 2.

The outer case 11 may be formed of a metal material, and the inner case 12 may be formed by injection of a plastic material.

Urethane foam insulation may be used as the insulator 13, and vacuum insulation panels may be used together as necessary.

A plurality of the storage compartments 2 may be partitioned by a partition 14, and a plurality of shelves 17 and storage boxes 18 may be provided inside the storage compartment 2.

The partition 14 may comprise a horizontal partition 14*a* arranged transversely in the storage compartment 2 and a vertical partition 14*b* arranged vertically in the storage compartment 2.

The storage compartment 2 may be divided into two storage compartments of upper and lower sides by the horizontal partition 14*a* and may be divided into two storage compartments of left and right sides by the vertical partition 14*b*.

In the present embodiment, the plurality of storage compartments 2 partitioned by the partition 14 may be referred to as a first storage compartment 2*a* located on the lower left side, a second storage compartment 2*b* located on the right side, and a third storage compartment 2*c* located on the upper side.

Although the first storage compartment 2*a* and the second storage compartment 2*b* may be used as freezing compartments, and the third storage compartment 2*c* may be used as a refrigerating compartment, at least one of the first storage compartment 2*a*, the second storage compartment 2*b* and the third storage compartment 2*c* may be used as a refrigerating compartment, a freezing compartment, or a variable temperature compartment as necessary.

The door 3 may include a pair of lower doors 3*b* to open and dose the first storage compartment 2*a* and the second storage compartment 2*b*, and a pair of upper doors 3*a* to open and close the third storage compartment 2*c*.

The pair of upper doors 3*a* and the pair of lower doors 3*b* may be coupled to the cabinet 10 to rotate in the left and right directions. Door guards 15 capable of storing food may be provided on rear surfaces of the pair of upper doors 3*a*.

One of the pair of upper doors 3*a* may be provided with a rotation bar 16. The rotation bar 16 may seal a gap between the pair of upper doors 3*a* when the pair of upper doors 3*a* are closed.

A cooling module mounting unit 20 on which the cooling module 100 is detachably mounted may be provided on a lower portion of the cabinet 10.

The cooling module mounting unit 20 may be provided in a size and shape corresponding to the cooling module 100.

The cooling module mounting unit 20 may be formed in a rectangular box shape such that the top, front, and opposite sides thereof may be in an covered state by an outer case 11*a* forming a bottom of the cabinet 10 and the rear thereof may be in an open state to allow the coding module 100 to enter therein.

The outer case 11*a* forming a ceiling of the cooling module mounting unit 20 may be provided with a first cold air inlet 21, a second cold air inlet 22, a first cold air outlet 23, and a second cold air outlet 24, which are formed by being cut.

Guide rails 25 may be installed at the opposite sides of the cooling module mounting unit 20 to guide the mounting of the cooling module 100 in a sliding manner.

The guide rails 25 may be provided with rollers 26 in rolling contact with guides 101 provided on opposite sides of the cooling module 100.

The cooling module 100 may be mounted on the cooling module mounting unit 20 by entering from the open rear of the cooling module mounting unit 20 and moving to the front of the cooling module mounting unit 20.

In this case, as the guides 101 provided on the opposite sides of the cooling module 100 slide along the guide rails 25 provided on the opposite sides of the cooling module mounting unit 20, the cooling module 100 is provided with the cooling module mounting unit 20. The guide 101 of the cooling module 100 may be provided with a roller 102 in rolling contact with the guide rail 25.

Such a rail-type mounting structure of the cooling module 100 is allowed to be easily detached from the cooling module mounting unit 20 during maintenance of the cooling module 100, thereby improving workability.

The cooling module 100 may generate cold air using the latent heat of evaporation of a refrigerant through a cooling cycle.

The cooling module 100 may include a pair of first connection openings 171 and 172 each communicating with the first cold air outlet 23 and the second cold air outlet 24 formed on the ceiling of the cooling module mounting unit 20, and a pair of second connection openings 173 and 174 each communicating with the first cold air inlet 21 and the second cold air inlet 22, when the cooling module 100 is completely mounted on the cooling module mounting unit 20.

The pair of first connection openings 171 and 172 may be openings for recovering cold air in the storage compartment 2 to the cooling module 100, and the pair of second connection openings 173 and 174 may be openings for supplying cold air generated in the cooling module 100 to the storage compartment 2.

When the cooling module 100 is completely mounted on the cooling module mounting unit 20, the first cold air outlet 23 and the second cold air outlet 24 may be connected to the pair of first connection openings 171 and 172, and the first cold air inlet 21 and the second cold air inlet 22 may be connected to the pair of second connection openings 173 and 174. In addition, sealing portions (not shown) to prevent leakage of cold air due to gaps when they are connected may be provided along circumferences of the pair of first connection openings 171 and 172 and the pair of second connection openings 173 and 174.

Figure 5:
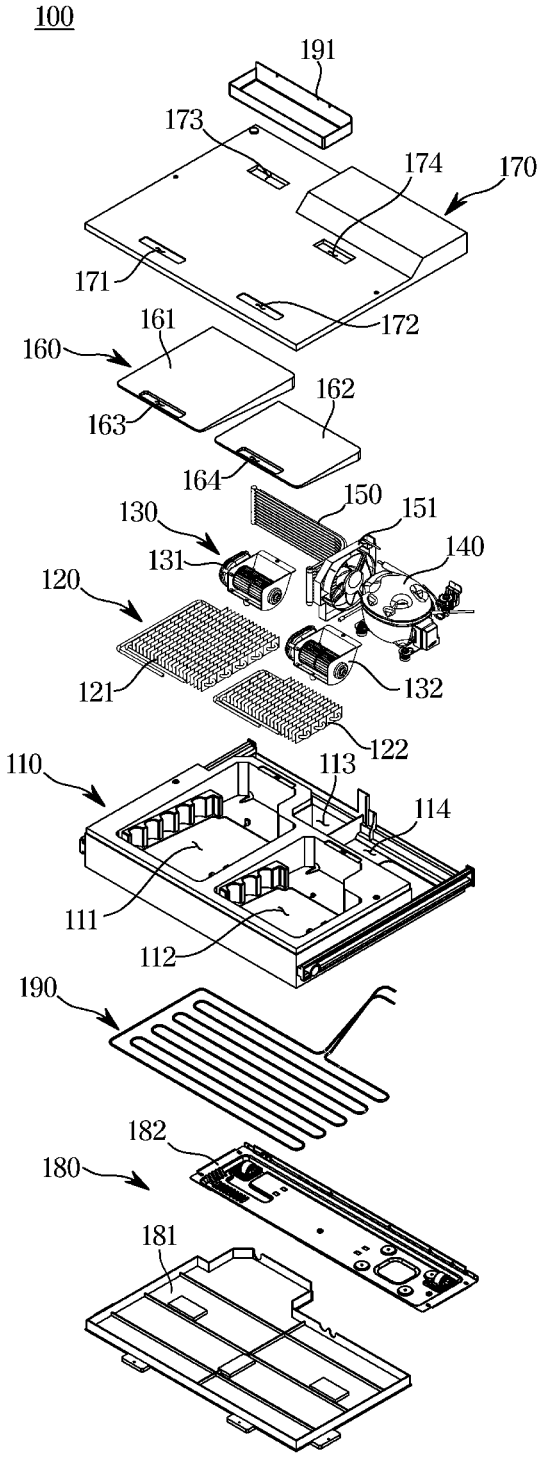
FIG. 5 is an exploded perspective view of the cooling module according to an embodiment of the disclosure.
Figure 6:
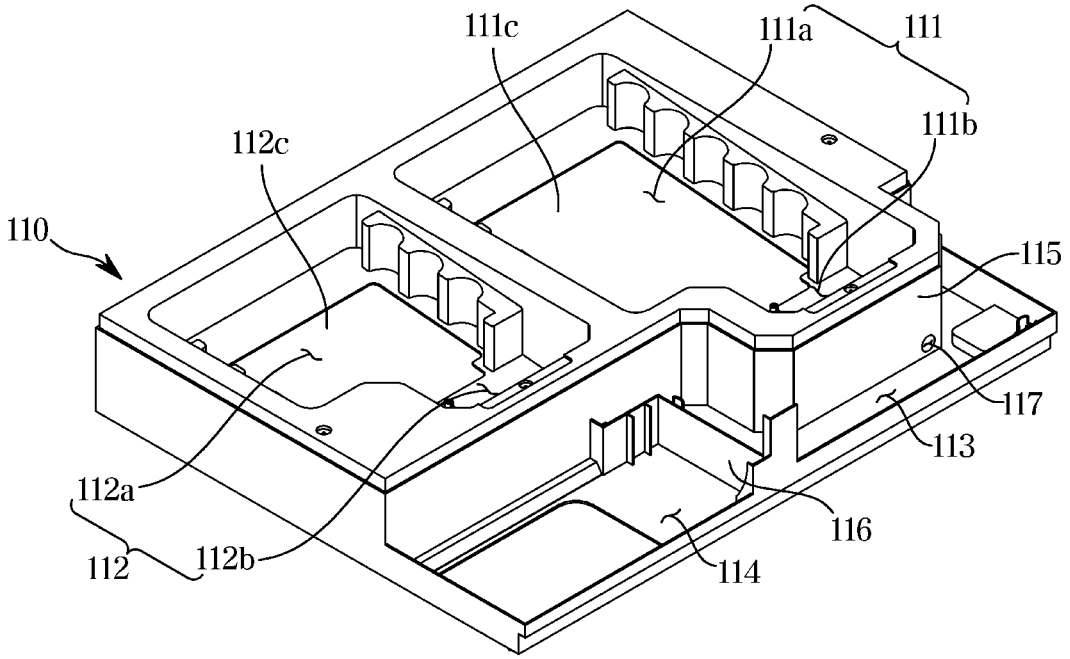
FIG. 6 is a perspective view of a module body according to an embodiment of the disclosure.
Figure 7:
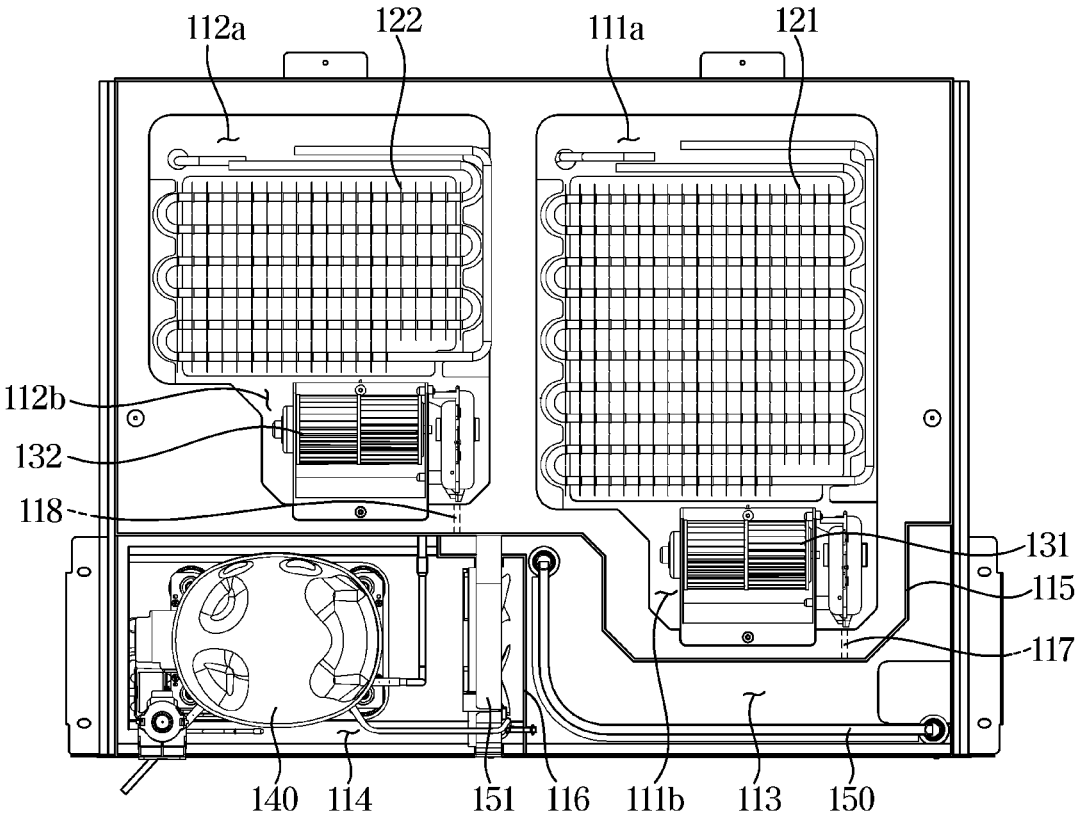
FIG. 7 illustrates components mounted on the module body according to an embodiment of the disclosure.

FIG. 5 is an exploded perspective view of the cooling module according to an embodiment of the disclosure, FIG. 6 is a perspective view of a module body according to an embodiment of the disclosure, and FIG. 7 illustrates components mounted on the module body according to an embodiment of the disclosure.

Referring to FIGS. 5 to 7, the cooling module 100 may include a module body 110, a module cover 170, a module base 180, a compressor 140, an evaporator 120, a condenser 150, a cooling fan 130, and an expansion valve (not shown).

The module body 110 may be formed in a rectangular box shape corresponding to the cooling module mounting unit 20, and the compressor 140, the evaporator 120, the condenser 150, the cooling fan 130, a condensing fan 151, and the like may be integrally installed in the module body 110.

The present embodiment illustrates as an example that the cooling module 100 includes two of the evaporators 120 and two of the cooling fans 130, but may be applied to a configuration having one evaporator and one cooling fan.

An insulator may be filled inside the module body 110 to prevent loss of cold air.

The module body 110 may include a first accommodating portion 111 and a second accommodating portion 112 capable of accommodating two of the evaporators 120 in a lying state, respectively.

The first accommodating portion 111 and the second accommodating portion 112 may be arranged side by side in a state of being partitioned from each other in the front of the module body 110 (a mounting direction of the cooling module).

The first accommodating portion 111 may have an area in which a first evaporator 121 may be accommodated in a lying state, and the second accommodating portion 112 may have an area in which a second evaporator 122 may be accommodated in a lying state.

The first accommodating portion 111 and the second accommodating portion 112 may be provided in a form recessed to accommodate the corresponding evaporators 121 and 122 on an upper surface of the module body 110, respectively.

The first evaporator 121 and a first cooling fan 131 may be accommodated together in the first accommodating portion 111.

The first accommodating portion 111 may be divided into a first region 111*a* in which the first evaporator 121 is seated in a lying state and a second region 111*b* in which the first cooling fan 131 is accommodated.

The second evaporator 122 and a second cooling fan 132 may be accommodated together in the second accommodating portion 112.

The second accommodating portion 112 may be divided into a first region 112*a* in which the second evaporator 122 is seated in a lying state and a second region 112*b* in which the second cooling fan 132 is accommodated.

Upper portions of the first accommodating portion 111 and the second accommodating portion 112 are covered by the evaporator cover 160 to prevent leakage of cold air generated by the first evaporator 121 and the second evaporator 122, respectively.

The evaporator cover 160 may include a first evaporator cover 161 covering the upper portion of the first accommodating portion 111 and a second evaporator cover 162 covering the upper portion of the second accommodating portion 112.

The first evaporator cover 161 may be provided to cover only an upper portion of the first region 111*a* in which the first evaporator 121 is located in the first accommodating portion 111, and the second evaporator cover 162 may be provided to cover only an upper portion of the first region 112*a* in which the second evaporator 122 is located in the second accommodating portion 112.

A first cold air recovery hole 163 and a second cold air recovery hole 164 each corresponding to the pair of first connection openings 171 and 172 formed on the module cover 170 may be formed on the first evaporator cover 161 and the second evaporator cover 162, respectively.

The cooling module 100 may be configured to supply cold air generated in the first accommodating portion 111 to at least two of the plurality of storage compartments 2 and to supply cold air generated in the second accommodating portion 112 to one of the plurality of storage compartments 2.

To this end, the first evaporator 121 accommodated in the first accommodating portion 111 may be formed to be relatively larger than the second evaporator 122 accommodated in the second accommodating portion 112.

A collecting portion 113 in which condensed water is collected and a compressor mounting portion 114 in which the compressor 140 is mounted may be disposed at the rear of the module body 110.

The collecting portion 113 and the compressor mounting portion 114 may be partitioned and arranged left and right by a fence 116 extending from the rear of the module body 110. The condensing fan 151 may be disposed on one side of the fence 116.

The condenser 150 may be fixedly installed in the collecting portion 113, and the compressor 140 may be fixedly installed in the compressor mounting portion 114.

The compressor 140 may compress a refrigerant and move the compressed refrigerant to the condenser 150. The condenser 150 may condense the refrigerant and move the condensed refrigerant to the expansion valve. The condensing fan 151 may cool the compressor 140 and the condenser 150.

The collecting portion 113 and the compressor mounting portion 114 may be integrally configured at the rear of the module body 110 in a state of being partitioned from each other by a partition wall 115 forming a portion of the first accommodating portion 111 and the second accommodating portion 112.

The collecting portion 113 may collect condensed water generated in the first accommodating portion 111 and the second accommodating portion 112. To this end, a first drain hole 117 and a second drain hole 118 for communicating two regions partitioned may be provided on the partition wall 115 partitioning the first and second accommodating portions 111 and 112 and the collecting portion 113.

A first bottom 111*c* of the first accommodating portion 111 and a second bottom 112*c* of the second accommodating portion 112 may be configured to be inclined downward toward the collecting portion 113 or the corresponding drain holes 117 and 118 so that condensed water may be smoothly collected into the collecting portion 113.

The module body 110 may be configured such that the first accommodating portion 111, the second accommodating portion 112, the collecting portion 113, and the compressor mounting portion 114 form one body.

The module base 180 may cover a lower portion of the module body 110.

The module base 180 may include a front module base 181 covering a front lower portion of the module body 110, and a rear module base 182 covering a rear lower portion of the module body 110.

A defrost heater 190 configured to defrost the evaporator 120 may be provided between the front module base 181 and the module body 110.

As the first evaporator 121 and the second evaporator 122 are disposed in a state lying on the accommodating portions 111 and 112, respectively, the defrost heater 190 transfers heat only to a distance equal to thicknesses of the first and second evaporators 121 and 122 during operation of the defrost heater 190 so that the defrosting of the first evaporator 121 and the second evaporator 122 may be completed in a short time.

The cooling module 100 may be integrally provided with an electrical module 191 configured to control the cooling module 100, The electrical module 191 may be disposed on an upper side of the module cover 170. The electrical module 191 may control the cooling module 100 to change a temperature of the storage compartment 2.

A circulation of cold air through the cooling module 100 and the storage compartment 2 may be performed through the cold air duct 40 provided in the cabinet 10.

Figure 8:
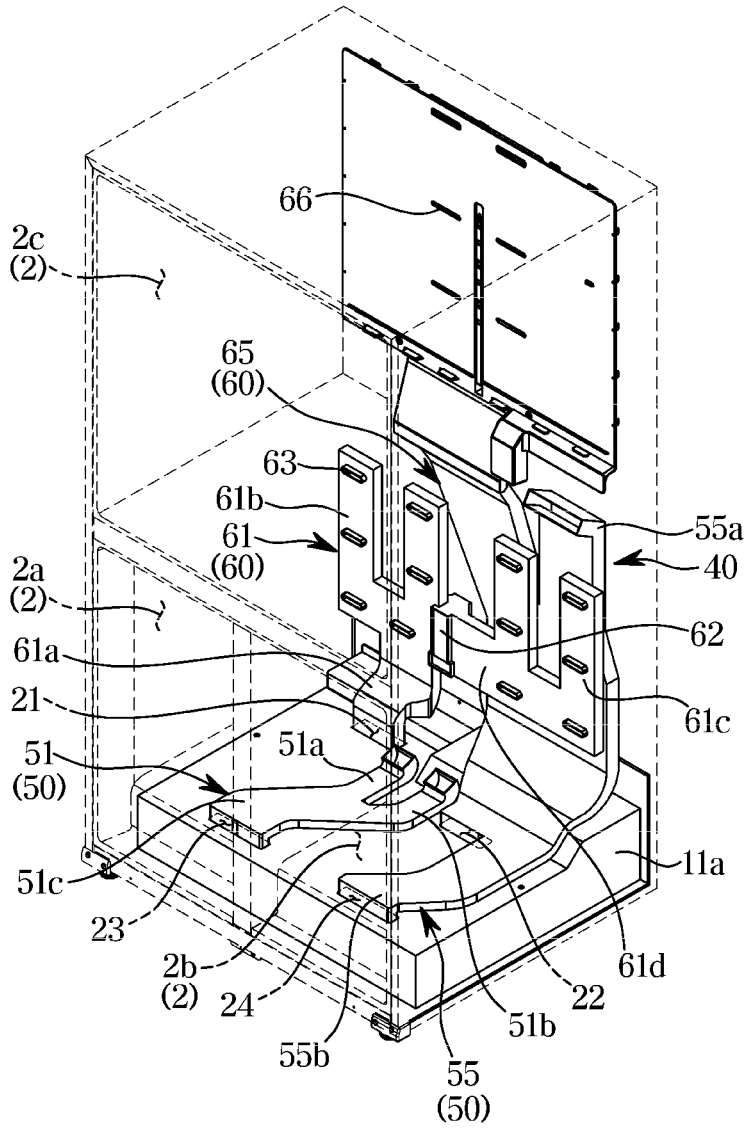
FIG. 8 is a front perspective view of a cold air duct according to an embodiment of the disclosure.
Figure 9:
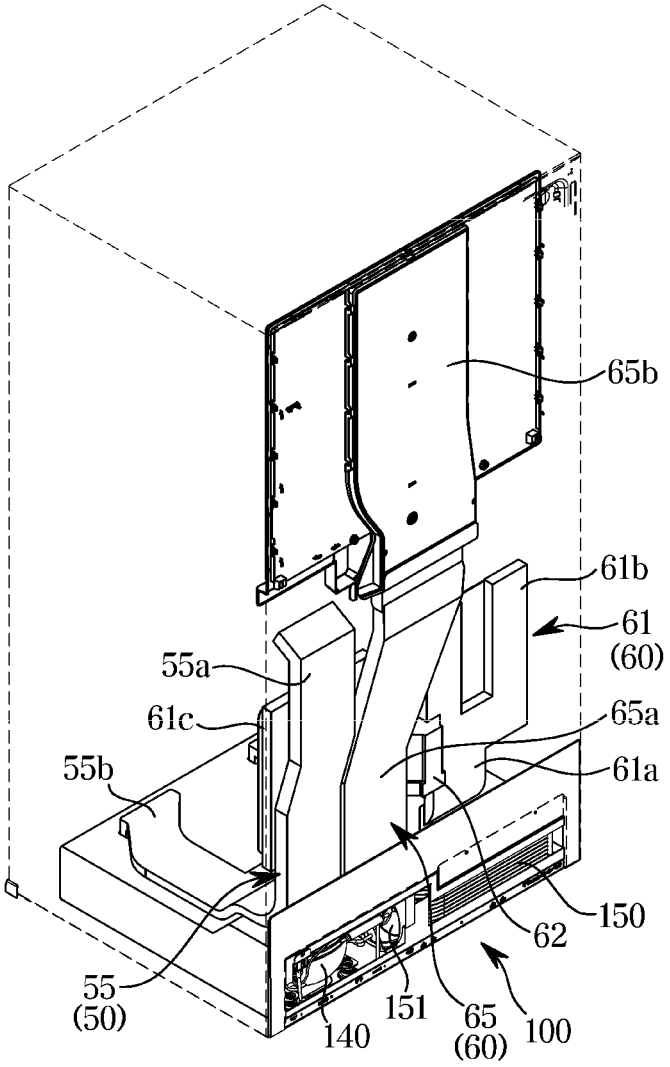
FIG. 9 is a rear perspective view of the cold air duct according to an embodiment of the disclosure.

FIG. 8 is a front perspective view of a cold air duct according to an embodiment of the disclosure, and FIG. 9 is a rear perspective view of the cold air duct according to an embodiment of the disclosure.

Referring to FIGS. 3, 8, and 9, the cold air duct 40 according to the present embodiment may be configured to be embedded in the insulator 13 provided between the outer case 11 and the inner case 12.

The cold air duct 40 may include a recovery duct 50 to recover cold air in the storage compartment 2 to the cooling module 100, and a supply duct 60 to supply cold air generated in the cooling module 100 to the storage compartment 2.

When the cooling module 100 is completely mounted in the cooling module mounting unit 20, the supply duct 60 may be in communication with the second connection openings 173 and 174 of the cooling module 100 to allow cold air to be supplied from the cooling module 100, and the recovery duct 50 may be in communication with the first connection openings 171 and 172 of the cooling module 100 to allow cold air in the storage compartment 2 to be supplied to the cooling module 100.

The supply duct 60 may include a first supply duct 61 to supply cold air generated in the first accommodating portion 111 of the cooling module 100 to the first storage compartment 2*a* and the second storage compartment 2*b*, and a second supply duct 65 to supply cold air generated in the second accommodating portion 112 of the cooling module 100 to the third storage compartment 2*c*.

One side of the first supply duct 61 is connected to the first cold air inlet 21, and the other side of the first supply duct 61 may be in communication with the first storage compartment 2*a* and the second storage compartment 2*b*.

The first supply duct 61 may include a first inlet portion 61*a* connected to the first cold air inlet 21 to allow cold air in the first accommodating portion 111 to be introduced therein, a pair of first discharge portions 61*b* and 61*c* each having a first cold air discharge port 63 to allow cold air discharged to be to the first storage compartment 2*a* and the second storage compartment 2*b*, and a first connection portion 61*d* connecting the pair of first discharge portions 61*b* and 61*c* and on which a damper 62 is installed.

Cold air introduced into the first inlet portion 61*a* by the opening and dosing operation of the damper 62 may be selectively supplied to the second storage compartment 2*b*. The damper 62 may be configured such that an opening degree thereof is adjusted so that the amount of cold air passing through the first connection portion 61*d* may be adjusted.

One side of the second supply duct 65 is connected to the second cold air inlet 22, and the other side of the second supply duct 65 may be in communication with the third storage compartment 2*c*.

The second supply duct 65 may include a second inlet portion 65*a* connected to the second cold air inlet 22 to allow cold air generated in the second accommodating portion 112 of the cooling module 100 to be introduced therein, and a second discharge portion 65*b* extending upward from the second inlet portion 65*a* to be positioned at the rear of the first storage compartment 2*a* and having a second cold air discharge port 66 to allow cold air to be discharged to the first storage compartment 2*a*.

The recovery duct 50 may include a first recovery duct 51 to supply cold air in the first storage compartment 2*a* and the second storage compartment 2*b* to the first accommodating portion 111 of the cooling module 100, and a second recovery duct 55 to supply cold air in the third storage compartment 2*c* to the second accommodating portion 112 of the cooling module 100.

One side of the first recovery duct 51 is connected to the first cold air outlet 23, and the other side of the first recovery duct 51 may be in communication with lower regions of the first storage compartment 2*a* and the second storage compartment 2*b*.

The first recovery duct 51 may include a first branch inlet portion 51*a* connected to the first storage compartment 2*a*, a second branch inlet portion 51*b* connected to the second storage compartment 2*b*, and a joining portion 51*c* where the first branch inlet portion 51*a* and the second branch inlet portion 51*b* join to allow cold air to be discharged to the first accommodating portion 111.

One side of the second recovery duct 55 is connected to the second cold air outlet 24, and the other side of the second recovery duct 55 may be in communication with a lower region of the third storage compartment 2*c*.

The second recovery duct 55 may include a recovery inlet portion 55*a* connected to the lower region of the third storage compartment 2*c* and extending downward, and a recovery discharge portion 55*b* horizontally extending from a lower end of the recovery inlet portion 55*a* toward the second cold air outlet 24.

Hereinafter, another embodiment according to the disclosure will be described in detail with reference to the accompanying drawings. Contents overlapping with the above-described embodiment according to the disclosure will be omitted, and different configurations will be mainly described.

Figure 10:
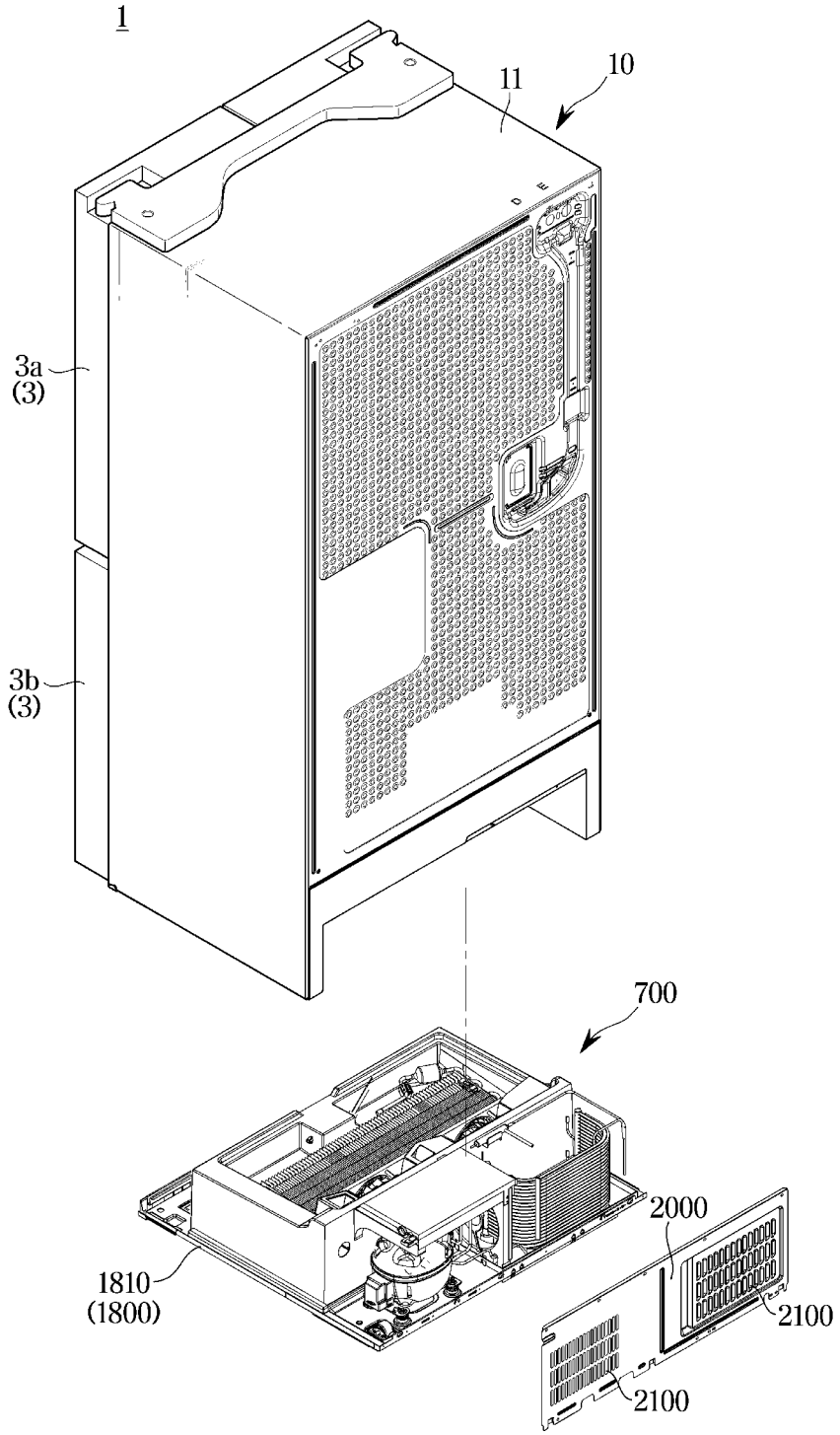
FIG. 10 is a perspective view illustrating a state in which a cooling module is separated from a cabinet in a refrigerator according to another embodiment of the disclosure.
Figure 11:
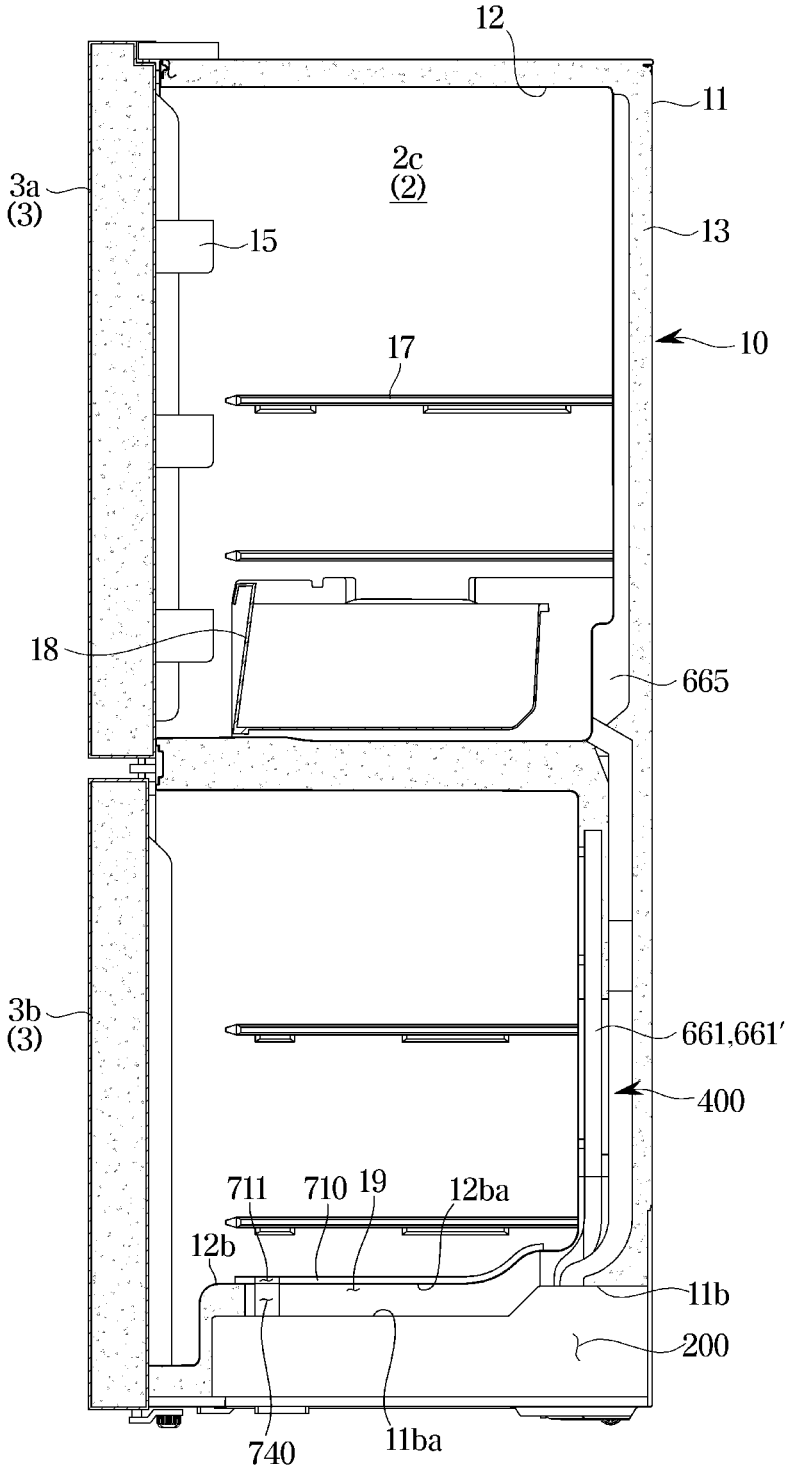
FIG. 11 is a cross-sectional view of the refrigerator according to another embodiment of the disclosure.
Figure 12:
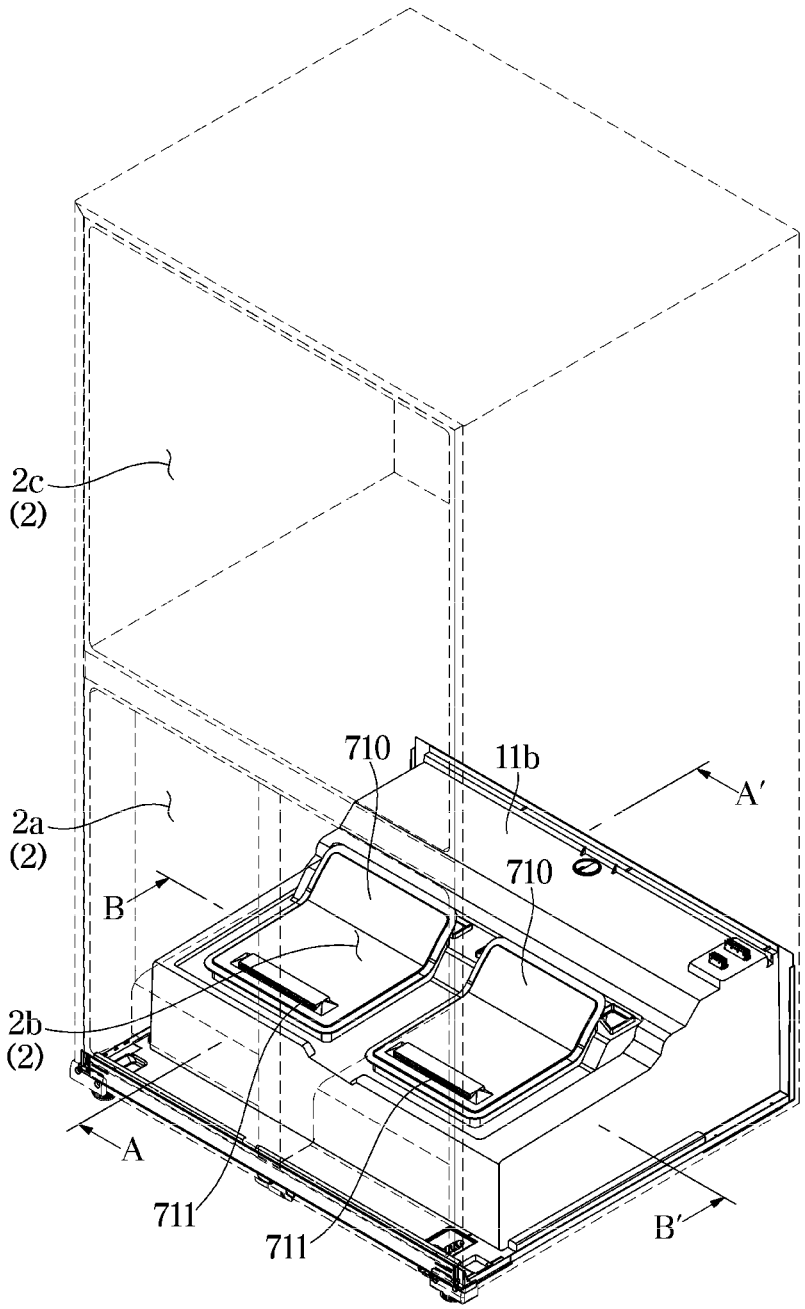
FIG. 12 is a perspective view of an outer case (bottom of an outer case) forming a cooling module mounting unit according to another embodiment of the disclosure.
Figure 13:
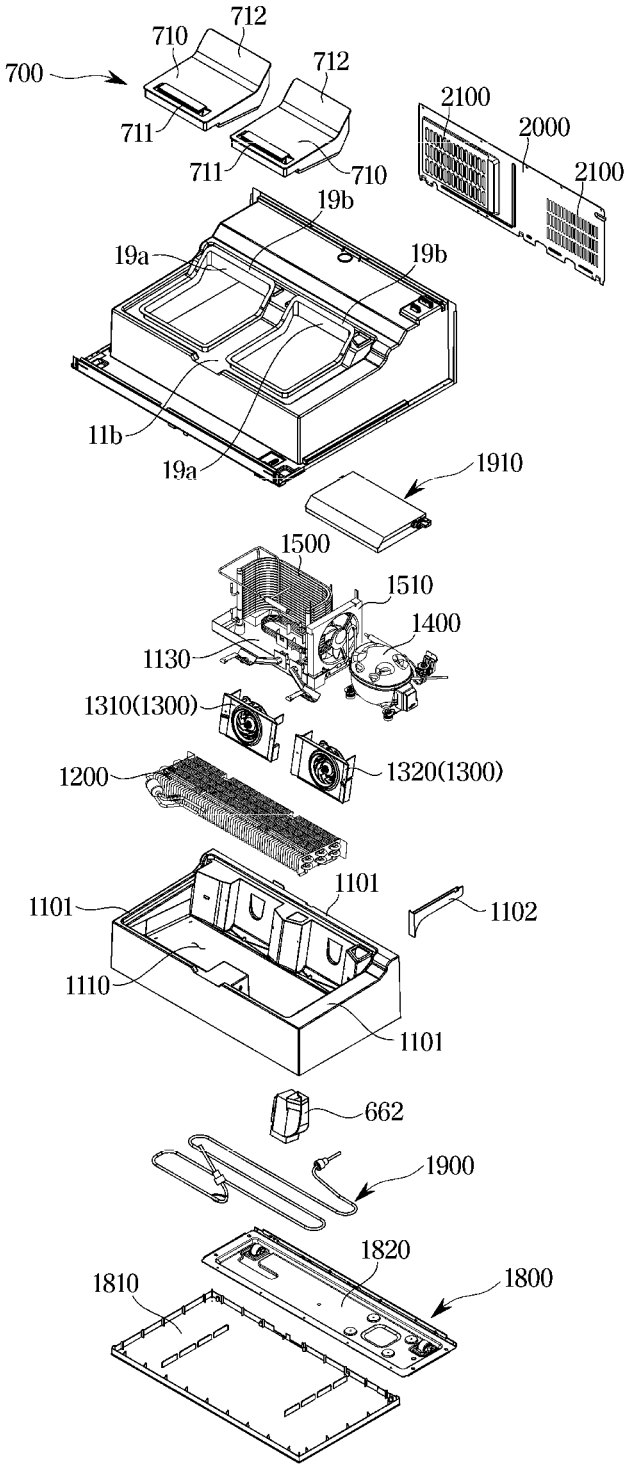
FIG. 13 is an exploded perspective view of the outer case and a cooling module according to another embodiment of the disclosure.
Figure 14:
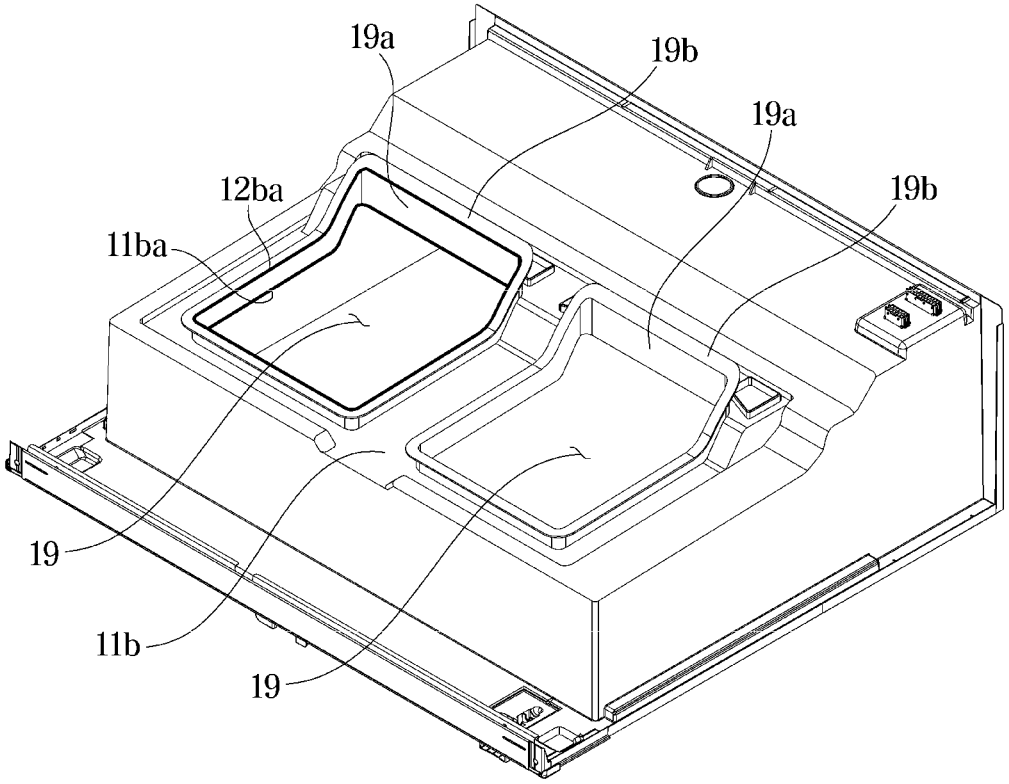
FIG. 14 is a perspective view illustrating an inner case bottom opening, an outer case bottom opening, and connection parts based on the outer case forming the cooling module mounting unit according to another embodiment of the disclosure.
Figure 15:
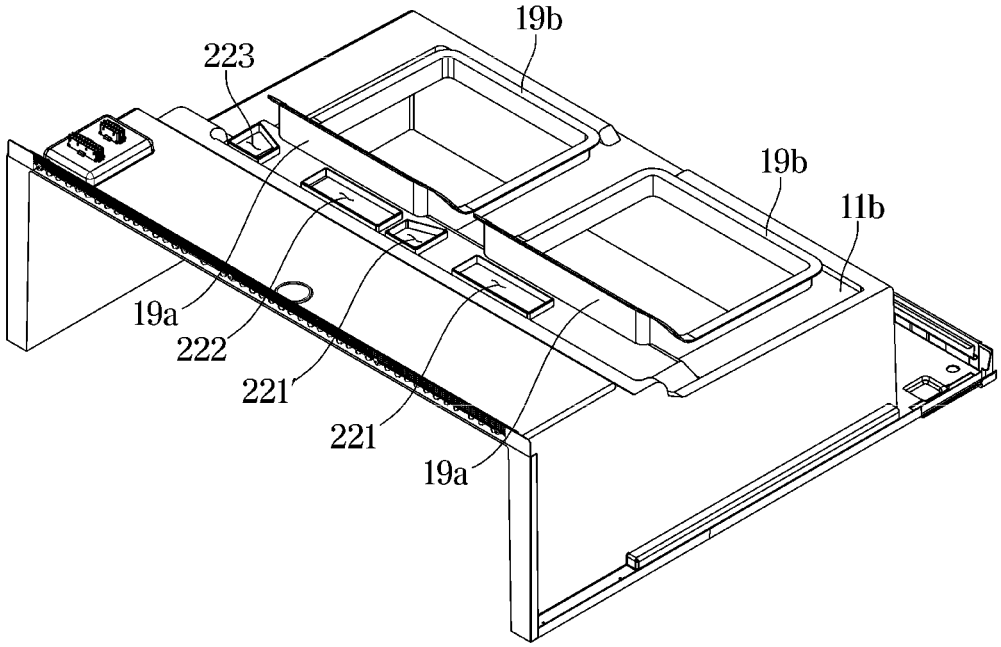
FIG. 15 is a perspective view of the outer case forming the cooling module mounting unit according to another embodiment of the disclosure, viewed in a different direction.
Figure 16:
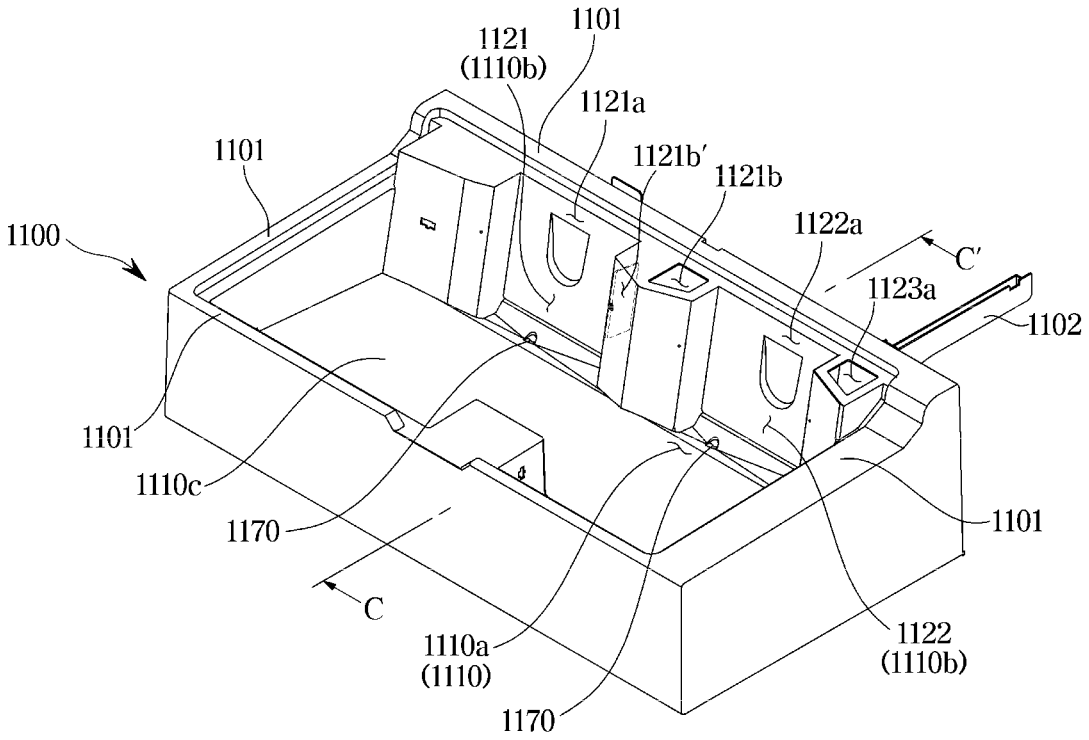
FIG. 16 is a perspective view of a module body according to another embodiment of the disclosure.
Figure 17:
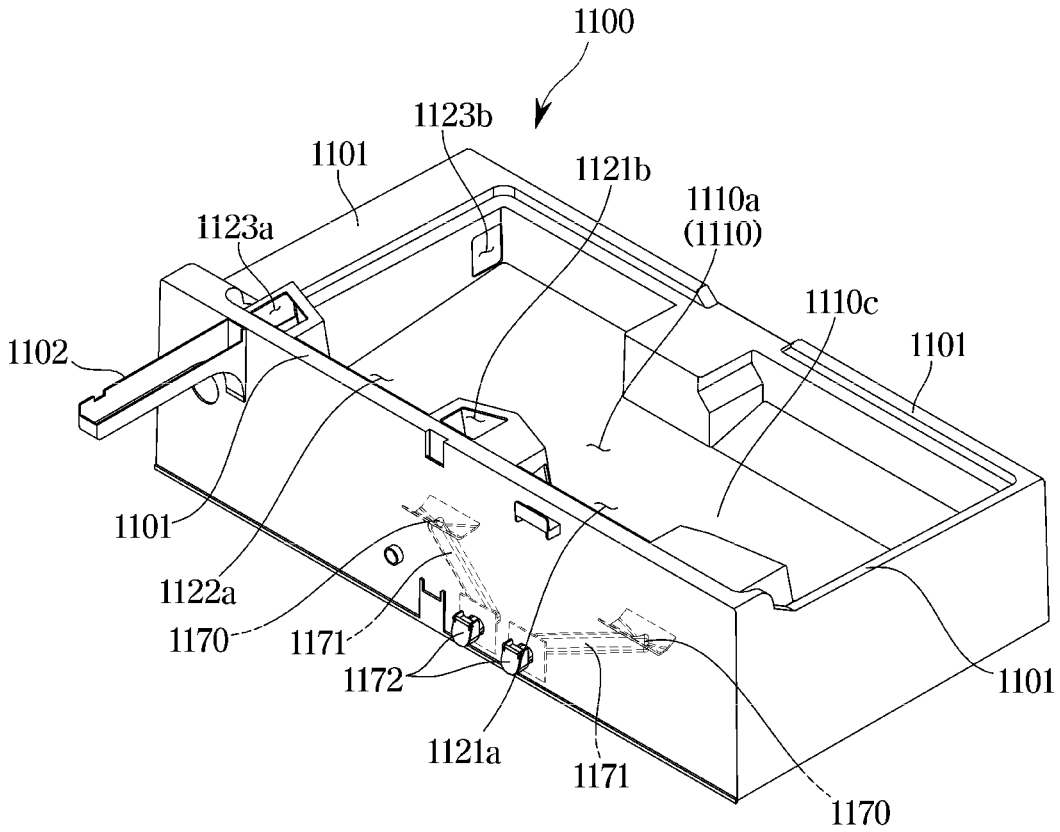
FIG. 17 is a perspective view of the module body viewed in a direction different from that of FIG. 16.
Figure 18:
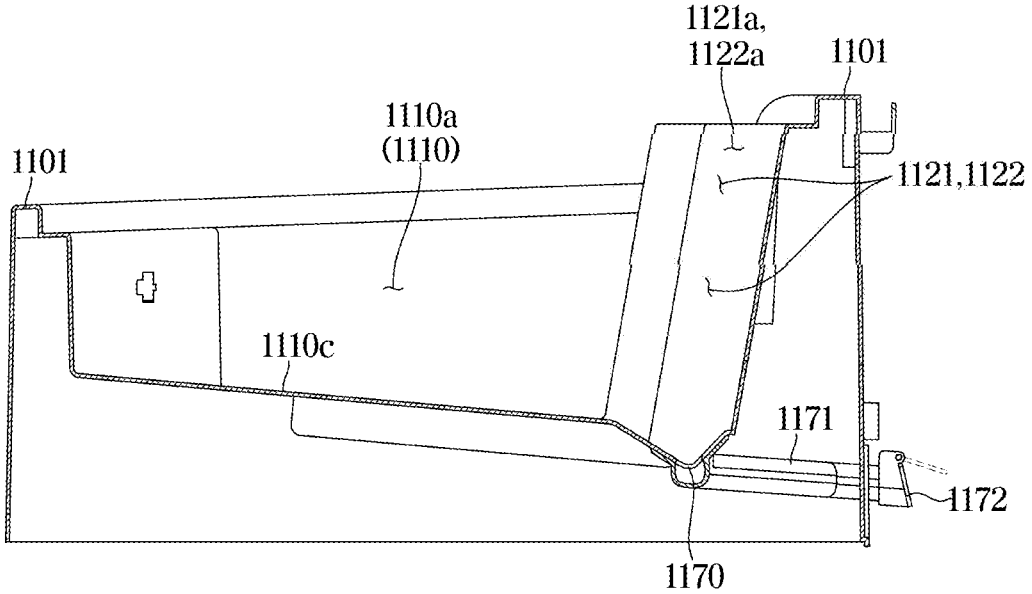
FIG. 18 is a cross-sectional view taken along line C-C in FIG. 16.
Figure 19:
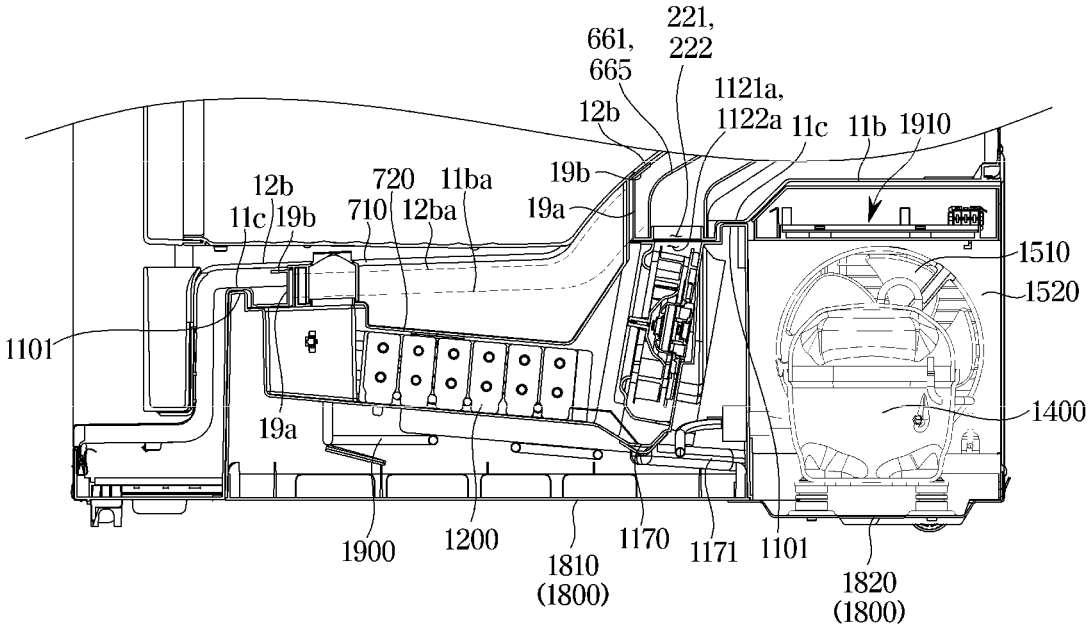
FIG. 19 is a cross-sectional view taken along line A-A in FIG. 12.
Figure 20:
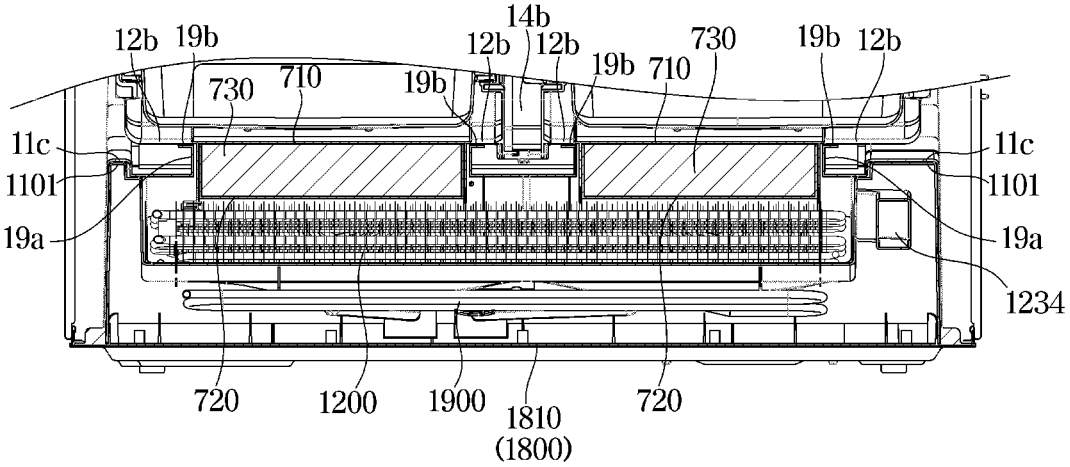
FIG. 20 is a cross-sectional view taken along line B-B in FIG. 12.
Figure 21:
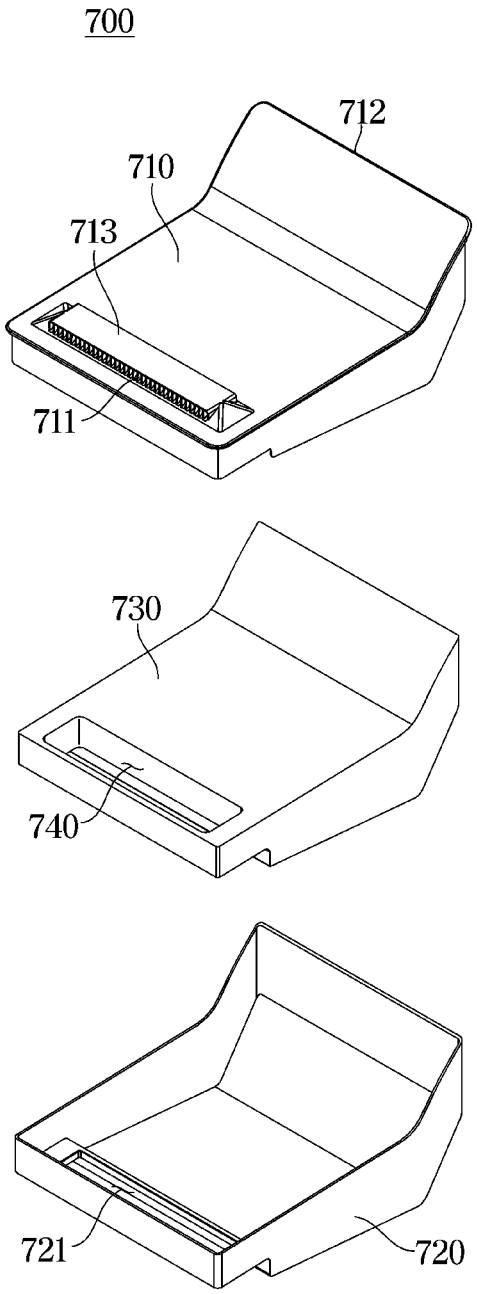
FIG. 21 is an exploded perspective view of a connection cover and a duct module according to another embodiment of the disclosure.

FIG. 10 is a perspective view illustrating a state in which a cooling module is separated from a cabinet in a refrigerator according to another embodiment of the disclosure. FIG. 11 is a cross-sectional view of the refrigerator according to another embodiment of the disclosure. FIG. 12 is a perspective view of an outer case forming a cooling module mounting unit according to another embodiment of the disclosure. FIG. 13 is an exploded perspective view of the outer case and a cooling module according to another embodiment of the disclosure. FIG. 14 is a perspective view illustrating an inner case bottom opening, an outer case bottom opening, and connection parts based on the outer case forming the cooling module mounting unit according to another embodiment of the disclosure. FIG. 15 is a perspective view of the outer case forming the cooling module mounting unit according to another embodiment of the disclosure, viewed in a different direction. FIG. 16 is a perspective view of a module body according to another embodiment of the disclosure. FIG. 17 is a perspective view of the module body viewed in a direction different from that of FIG. 16. FIG. 18 is a cross-sectional view taken along line C-C in FIG. 16. FIG. 19 is a cross-sectional view taken along line A-A in FIG. 12. FIG. 20 is a cross-sectional view taken along line B-B in FIG. 12. FIG. 21 is an exploded perspective view of a connection cover and a duct module according to another embodiment of the disclosure.

A cooling module mounting unit 200 on which a cooling module 1000 is detachably mounted may be provided a lower portion of the cabinet 10.

The cooling module mounting unit 200 may be provided in a size and shape corresponding to the cooling module 1000.

The cooling module mounting unit 200 may be formed in a rectangular box shape such that the top, front, and opposite sides thereof may be in an covered state by an outer case 11*b* forming a bottom of the cabinet 10 and the rear thereof may be in an open state to be covered by a module rear cover 2000 (see FIG. 13). The cooling module mounting unit 200 may be provided such that a lower side thereof may be in an open state.

The cooling module 1000 may be mounted on the cooling module mounting unit 200 by entering from the open lower side of the cooling module mounting unit 200 and moving to an upper side of the cooling module mounting unit 200.

The outer case 11*b* forming a ceiling of the cooling module mounting unit 200 may be referred to as the outer case floor 11*b*. Hereinafter, the both terms will be used. The outer case bottom 11*b* may be manufactured separately from the rest of the outer case 11 except for the outer case bottom 11*b*. Or, the outer case 11 may be integrally formed with the outer case bottom 11*b*.

The outer case 11*b* forming the ceiling of the cooling module mounting unit 200, that is, the outer case bottom 11*b* may be provided with a first cold air inlet 221, a second cold air inlet 221', and a third cold air inlet 222. The outer case 11*b* forming the ceiling of the cooling module mounting unit 200, that is, the outer case bottom 11*b* may be provided with a cold air outlet 223.

An outer case bottom opening 11*ba* may be formed on the outer case bottom 11*b*. The outer case bottom opening 11*ba* may be provided in a shape corresponding to an accommodating portion 1110 of the cooling module 1000 introduced into the cooling module mounting unit 200. The accommodating portion 1110 will be described in detail later.

An inner case bottom opening 12*ba* may be formed on an inner case bottom 12*b*. The inner case bottom opening 12*ba* may be provided in a shape corresponding to the outer case bottom opening 11*ba* described above.

The outer case bottom opening 11*ba* and the inner case bottom opening 12*ba* may be formed in a flat surface shape, but as illustrated in FIG. 14, may be formed in a curved or bent surface shape depending on the shape of the cooling module mounting unit 200 or the cooling module 1000.

The refrigerator 1 according to another embodiment of the disclosure may further include a connection part 19 to allow the cooling module 1000 to be in communication with the storage compartment 2 when the cooling module 1000 is mounted on the cooling module mounting unit 200. Specifically, the connection part 19 may be provided such that the cooling module 1000 is in communication with the lower storage compartments 2*a* and 2*b* of the two upper and lower storage compartments partitioned by the horizontal partition 14*a*.

The inner case bottom opening 12*ba* and the outer case bottom opening 11*ba* may be disposed at upper and lower ends of the connection part 19, respectively. In other words, the inner case bottom opening 12*ba* may be positioned at the upper end of the connection part 19, and the outer case bottom opening 11*ba* may be positioned at the lower end of the connection part 19.

Accordingly, even in a state where the cooling module 1000 is mounted on the cooling module mounting unit 200, a user may access the cooling module 1000 through the connection part 19 described above by opening the pair of lower doors 3*b* to open the lower storage compartments 2*a*, 2*b*. Specifically, the user may access the accommodating portion 1110 of the cooling module 1000 through the connection part 19.

Referring to FIGS. 12 to 15, 19, and 20, the refrigerator 1 according to another embodiment of the disclosure may further include an access neck 19*a* formed along a circumference of the outer case bottom opening 11*ba*, and a neck flange 19*b* formed at one end of the access neck 19*a*. The inner case bottom opening 12*ba* may be positioned at one end of the access neck 19*a*. Accordingly, a shape of an inner edge of the neck flange 19*b* formed at one end of the access neck 19*a* may substantially correspond to the shape of the inner case bottom opening 12*ba*. Or, the inner case bottom opening 12*ba* may be formed by the inner edge of the neck flange 19*b* formed at one end of the access neck 19*a*.

The access neck 19*a* is formed along the circumference of the outer case bottom opening 11*ba* and may protrude from the outer case bottom 11*b* toward the inner case bottom opening 12*ba*. The neck flange 19*b* formed at one end of the access neck 19*a* may be fixed in a state of being in contact with a lower surface of the inner case bottom 12*b* positioned a circumference of the inner case bottom opening 12*ba*. The connection part 19 described above may be formed inside the access neck 19*a*. An outer circumference of the access neck 19*a* forms a space between the inner case floor 12*b* and the outer case floor 11*b*, and thus the insulator 13 may be filled in this space.

Referring to FIGS. 12 and 13, the refrigerator 1 according to another embodiment of the disclosure may further include a connection cover 710 to open and close the inner case bottom opening 12*ba*. The connection cover 710 may have a locking portion 712 formed along an upper edge of the connection cover 710. Or, the upper edge of the connection cover 710 may be defined as the locking portion 712.

The upper edge of the connection cover 710, that is, the locking portion 712 may be provided to be caught on the inner case bottom 12*b* positioned at an edge of the inner case bottom opening 12*ba*. An area in which the upper edge of the connection cover 710 is formed may be larger than an area in which the edge of the inner case bottom opening 12*ba* is formed. Accordingly, while the connection cover 710 may approach the connection part 19 from above the connection part 19, the locking portion 712 may be caught on the inner case bottom 12*b*.

The connection cover 710 may form an interior of the lower storage compartments 2*a* and 2*b* together with the inner case bottom 12*b* in a state in which the connection cover 710 closes the upper end of the connection part 19, that is, the inner case bottom opening 12*ba*.

The connection cover 710 may further include a connection opening 711 through which the connection part 19 and the lower storage compartments 2*a* and 2*b* communicate in a state in which the connection cover 710 closes the inner case bottom opening 12*ba*. Recovery cold air in the lower storage compartments 2*a* and 2*b* may pass through the connection opening 711 of the connection cover 710, and then pass through the connection part 19 and be introduced into the accommodating portion 1110 of the cooling module 1000.

A duct module body 720 may be disposed below the connection cover 710. The connection cover 710 may be coupled to an upper end of the duct module body 720. An insulator 730 may be disposed inside the duct module body 720. The connection cover 710, the insulator 730, and the duct module body 720 may form one of the duct module 700. The duct module 700 will be described in detail later.

The cooling module 1000 may generate cold air by using the latent heat of evaporation of a refrigerant through a cooling cycle.

The cooling module 1000 may include a first blowing opening 1121*a*, a second blowing opening 1121*b*, and a third blowing opening 112*ea* each communicating with the first cold air outlet 23 and the second cold air outlet 24 formed on the ceiling of the cooling module mounting unit 20, and a pair of second connection openings 173 and 174 each communicating with the first cold air inlet 221, the second cold air inlet 221', and the third cold air inlet 222, which are formed on the ceiling of the cooling module mounting unit 200, when the cooling module 1000 is completely mounted on the cooling module mounting unit 200.

The cooling module 1000 may include a first recovery port 1123*a* communicating with the cold air outlet 223 formed on the ceiling of the cooling module mounting unit 200 when the cooling module 1000 is completely mounted on the cooling module mounting unit 200.

The first recovery port 1123*a* may be an opening for recovering cold air in the storage compartment 2 to the cooling module 1000, and the first cold air inlet 221, the second cold air inlet 221', and the third cold air inlet 222 may be openings for supplying cold air generated in the cooling module 1000 to the storage compartment 2.

The cooling module 1000 may include a module body 1100, a module base 1800, a compressor 1400, an evaporator 1200, a condenser 1500, cooling fans 1310 and 1320, and an expansion valve (not shown). The module base 1800 may include a front module base 1810 and a rear module base 1820. The front module base 1810 is disposed below the module body 1100 and may be coupled to a lower end of the module body 1100.

The module body 1100 may be formed in a rectangular box shape corresponding to the cooling module mounting unit 200, and the evaporator 1200, a cooling fan 1300, and the like may be integrally installed in the module body 1100. Unlike the module body 110[A1] according to an embodiment of the disclosure, the condenser 1500, a condensing fan 1510, and the compressor 1400 are not integrally installed in the module body 1100 according to another embodiment of the disclosure, but may be installed on the rear module base 1820 and then disposed at the rear of the module body 1100.

However, the disclosure is not limited thereto, and as in the module body 110 of an embodiment of the disclosure, the compressor 1400, the evaporator 1200, the condenser 1500, the cooling fan 1300, the condensing fan 1510, and the like may be integrally installed in the module body 1100.

The present embodiment illustrates as an example that the cooling module 1000 includes one of the evaporator 1200 and two of the cooling fans 1300, but may be applied to a configuration having a plurality of evaporators and one cooling fan.

An insulator to prevent loss of cold air may be filled inside the module body 1100.

The module body 1100 may include the accommodating portion 1110 capable of accommodating one of the evaporator 1200 in a lying state. The evaporator 1200 may be disposed in a lying state in the accommodating portion 1110. The evaporator 1200 may be disposed in the accommodating portion 1110 to extend left and right with respect to the front (the direction in which the door 3 is arranged in the refrigerator 1). Referring to an embodiment of the disclosure, the evaporator 1200 may be disposed in a lying state over regions corresponding to the first accommodating portion 111 and the second accommodating portion 112.

The accommodating portion 1110 may have an area in which the evaporator 1200 may be accommodated in a laying state.

The accommodating portion 1110 may be provided in a form recessed from an upper surface of the module body 1100 to accommodate the corresponding evaporator 1200.

The evaporator 1200, the first cooling fan 1310, and the second cooling fan 1320 may be accommodated together in the accommodating portion 1110. The accommodating portion 1110 may be divided into a first region 1110*a* in which the evaporator 1200 seated in a lying state and a second region 1110*b* in which the first cooling fan 1310 and the second cooling fan 1320 are accommodated. The second region 1110*b* may be further divided into two regions according to the number of the cooling fans. The second region 1110*b* may include a first cooling fan seating portion 1121 and a second cooling fan seating portion 1122.

The first blowing opening 1121*a* may be formed at an upper end of the first cooling fan seating portion 1121. A third blowing opening 1122*a* may be formed at an upper end of the second cooling fan seating portion 1122. The second blowing opening 1121*b* may be formed in a region adjacent to the second blowing opening 1121*b* of the module body 1100. The first recovery port 1123*a* may be formed in a region adjacent to the third blowing opening 1122*a* of the module body 1100. However, the formation positions of the second blowing opening 1121*b* and the first recovery port 1123*a* on the module body 1100 are not limited thereto.

Unlike the module body 110 according to an embodiment of the disclosure, the first evaporator cover 161 and the second evaporator cover 162 or the module cover 170 are not separately provided in the module body 1100 according to another embodiment of the disclosure, but may be provided directly in close contact with the outer case bottom 11*b*. Accordingly, the first blowing opening 1121*a* and the second blowing opening 1121*b* may be provided in an open form in a partial region of an upper end of the module body 1100. When the cooling module 1000 is mounted on the cooling module mounting unit 200, the upper surface of the module body 1100 may be in dose contact with the outer case bottom 11*b*. In this state, the first blowing opening 1121*a* may be in close contact with and in communication with the first cold air inlet 221, the second blowing opening 1121*b* may be in close contact with and in communication with the second cold air inlet 221', and the third blowing opening 1122*a* may be in close contact with and in communication with the third cold air inlet 222. Similarly, the first recovery port 1123*a* may be in close contact with and in communication with the cold air outlet 223.

Unlike the module body 110 according to an embodiment of the disclosure, the module body 1100 according to another embodiment of the disclosure may simplify a manufacturing process and reduce costs in that the first evaporator cover 161 and the second evaporator cover 162 or the module cover 170 may be omitted. However, only the close contact structure between the outer case bottom 11*b* of the cooling module mounting unit 200 and the upper end of the module body 1100 may not prevent loss of cold air.

In order to prevent the loss of cold air, the cooling module 1000 may include a protrusion 1101, and the outer case bottom 11*b* may include a depression 11*c*. The depression 11*c* may be provided in a shape corresponding to the protrusion 1101.

Referring to FIGS. 16 to 19, the protrusion 1101 may be formed along an upper edge of the module body 1100. The protrusion 1101 of the module body 1100 according to another embodiment of the disclosure may be formed to have a different thickness for each corner forming the edge thereof. For example, the protrusion 1101 formed in an upper left corner with respect to the front (the arrangement direction of the door 3 in the refrigerator 1) may be formed thicker than the protrusion 1101 formed in another corner. Or, as illustrated in FIG. 17, the protrusion 1101 formed in front of the upper edge of the module body 1100 may be formed thinner than the protrusion 1101 formed in the rear. However, the disclosure is not limited thereto, and the protrusion 1101 of the module body 1100 may be formed to have the same thickness along each corner forming the edge thereof.

Referring to FIGS. 18 and 19, the outer case bottom 11*b* may further include the depression 11*c* corresponding to the shape of the protrusion 1101. The depression 11*c* may be formed on a portion of a surface of the outer case bottom 11*b* facing the cooling module mounting unit 200.

As illustrated in FIG. 18, when the cooling module 1000 is mounted on the cooling module mounting unit 200, the upper surface of the module body 1100 may be in close contact with the outer case bottom 11*b*. In this state, the first blowing opening 1121*a* may be in close contact with and in communication with the first cold air inlet 221. Or, the third blowing opening 1122*a* may be in dose contact with and in communication with the third cold air inlet 222.

With this structure, the depression 11*c* of the outer case bottom 11*b* and the protrusion 1101 in the upper edge region of the module body 1100 are engaged in the cooling module mounting unit 200, so that the airtightness between the cooling module 1000 and the storage compartment 2 may be further improved. When the cooling module 1000 is mounted on the cooling module mounting unit 200, the protrusion 1101 and the depression 11*c* are in close contact, so that the outflow of cold air near the upper edge of the module body 1100 may be blocked.

The cooling module 1000 may be configured to supply cold air blown by the first cooling fan 1310 to at least two storage compartments of the plurality of storage compartments 2 and to supply cold air blown by the second cooling fan 1320 to one storage compartments of the plurality of storage compartments 2.

Therefore, blowing outputs of the first cooling fan 1310 and the second cooling fan 1320 may be set differently.

A collecting portion 1130 in which condensed water is collected and the compressor 1400 may be disposed at the rear of the module body 1100. As described above, unlike the module body 110 according to an embodiment of the disclosure, the collecting portion 1130 and the compressor mounting portion may not be integrally formed in the module body 1100 according to another embodiment of the disclosure. Therefore, the collecting portion 1130 may be separately provided in the form of a box with an open top. The collecting portion 1130 and the compressor 1400 may be fixed on the rear module base 1820. The rear module base 1820 may be arranged side by side in a front-rear direction of the front module base 1810 to which the module body 1100 is fixed. The rear module base 1820 may be coupled side by side in the front-rear direction of the front module base 1810 to which the module body 1100 is fixed to configure the cooling module 1000.

The collecting portion 1130 and the compressor module may be divided left and right by a condensing fan 1510 and arranged side by side. The condensing fan 1510 may be provided as an axial fan. A condensing fan cover 1520 surrounding the condensing fan 1510 may be provided around the condensing fan 1510. The condensing fan cover 1520 may be provided in a substantially rectangular parallelepiped shape. Referring to FIG. 19, a height of the condensing fan cover 1520 may be provided to substantially correspond to a height of the module body 1100.

The condenser 1500 may be fixedly installed in the collecting portion 1130. The compressor 1400 may compress a refrigerant and move the compressed refrigerant to the condenser 1500. The condenser 1500 may condense the refrigerant and move the condensed refrigerant to the expansion valve. The condensing fan 1510 may cool the compressor 1400 and the condenser 1500.

Referring to FIGS. 17 to 20, the collecting portion 1130 may be arranged adjacent to each other in a front-rear direction of the module body 1100 with a partition wall of the module body 1100 forming the accommodating portion 1110 therebetween.

The accommodating portion 1110 and the collecting portion 1130 may be in communication with each other through a drain hole 1170 formed on the accommodating portion 1110 and a drain pipe 1171[A2] connected to the drain hole 1170, The drain hole 1170 according to another embodiment of the disclosure and the drain pipe 1171 corresponding thereto may be formed in plural numbers. However, the disclosure is not limited thereto, and the drain hole 1170 and the drain pipe 1171 corresponding thereto may be provided in a single configuration.

Specifically, the drain holes 1170 may be formed on a portion of a bottom of the accommodating portion 1110. Referring to FIG. 16, the drain holes 1170 may be formed at lower ends of the first cooling fan seating portion 1121 and the second cooling fan seating portion 1122 on the bottom of the accommodating portion 1110, respectively.

The bottom of the accommodating portion 1110 may be formed to be inclined downward toward the collecting portion 1130. In the accommodating portion 1110, the first cooling fan seating portion 1121 and the second cooling fan seating portion 1122 are disposed relatively rearward, and may be positioned adjacent to the collecting portion 1130 with the partition wall of the module body 1100 forming the accommodating portion 1110 therebetween, A partial inclined surface larger than an overall slope of the bottom of the accommodating portion 1110 may be formed in a region surrounding the drain hole 1170.

The drain pipe 1171 may be connected to a lower end of the drain hole 1170. The drain pipe 1171 may also be provided to be inclined downward toward the collecting portion 1130 similar to the bottom of the accommodating portion 1110.

The bottom of the accommodating portion 1110 is configured to be inclined downward toward the collecting portion 1130 or the corresponding drain hole 1170, and the drain pipe 1172 connected to the drain hole 1170 is configured to be inclined downward toward the collecting portion 1130, so that condensed water may be smoothly collected into the collecting portion 1130.

Referring to FIG. 18, a drain cap 1172 rotatably coupled to one end of the drain pipe 1172 may be provided. The drain cap 1172 may be provided to open and close one end of the drain pipe 1171 by an own weight thereof.

Specifically, condensed water may be collected along the slope of the drain pipe 1171 in a state in which the drain cap 1172 closes one end of the drain pipe 1171. When a certain amount of condensed water is collected, the drain cap 1172 may be rotated by the weight of the collected condensed water to open one end of the drain pipe 1171. The collected condensed water flows out to the collecting portion 1130.

Because one end of the drain pipe 1171 is not normally opened, vapor by the condenser 1500 may be prevented from flowing back into the evaporator 1200. Condensation of the vapor by the condenser 1500 on the evaporator 1200 may be effectively prevented.

The module base 1800 may cover a lower portion of the module body 1100.

The module base 1800 may include a front module base 1810 covering a front lower portion of the module body 1100, and a rear module base 182 covering lower portions of the condenser 1500, the collecting portion 1130 to which the condenser 1500 is fixed, the condensing fan cover 1520 and the compressor 1400. The condenser 1500, the collecting portion 1130 to which the condenser 1500 is fixed, the condensing fan cover 1520 and the compressor 1400 may be arranged side by side to be fixed to the rear module base 1820.

Referring to FIGS. 19 and 20, a defrost heater 1900 configured to defrost the evaporator 1200 may be provided between the front module base 1810 and the module body 1100.

As the evaporator 1200 is disposed in a state lying on the accommodating portion 1110, the defrost heater 1900 transfers heat only to a distance equal to a thickness of the evaporator 1200 during operation of the defrost heater 1900 so that the defrosting of the evaporator 1200 may be completed in a short time.

Referring to FIGS. 12, 13, and 19 to 21, the refrigerator 1 according to another embodiment of the disclosure may further include the connection cover 710 to open and close the inner case bottom opening 12*ba*.

The upper edge of the connection cover 710, that is, the locking portion 712 may be provided to be caught on the inner case bottom 12*b* positioned at an edge of the inner case bottom opening 12*ba*. The connection cover 710 may form an interior of the lower storage compartments 2*a* and 2*b* together with the inner case bottom 12*b* in a state in which the connection cover 710 closes the upper end of the connection part 19, that is, the inner case bottom opening 12*ba*.

The connection cover 710 may further include the connection opening 711 through which the connection part 19 and the lower storage compartments 2*a* and 2*b* communicate in a state in which the connection cover 710 closes the inner case bottom opening 12*ba*.

The connection opening 711 may be formed by being cut on the connection cover 710. The connection opening 711 may be formed on the connection cover 710 in a region adjacent to the lower door 3*b*. The connection opening 711 may be positioned at an upper front of the connection cover 710.

The duct module body 720 may be disposed below the connection cover 710. The connection cover 710 may be coupled to the upper end of the duct module body 720. The insulator 730 may be disposed inside the duct module body 720. The connection cover 710, the insulator 730, and the duct module body 720 may form one of the duct module 700.

The duct module body 720 may be provided in a form recessed to accommodate the insulator 730 therein. Like the insulator 13 filled between the outer case 11 and the inner case 12, urethane foam insulation may be used as the insulator 730, and vacuum insulation panels may be used together as necessary.

Referring to FIG. 19, a vertical width of the duct module body 720 may be formed larger than a vertical width of the connection part 19. In other words, the vertical width of the duct module body 720 may be formed larger than a distance between the inner case bottom opening 12*ba* disposed at the upper end of the connection part 19 and the outer case bottom opening 11*ba* disposed at the lower end of the connection part 19. Accordingly, the bottom of the duct module body 720 may pass through the outer case bottom opening 11*ba* and face an upper surface of the evaporator 1200 at a slight distance.

A first recovery duct 740 passing through the insulator 730 and communicating with the connection opening 711 may be provided below the connection opening 711. The connection opening 711 may be disposed at an upper end of the first recovery duct 740. An accommodating portion communication port 721 may be formed at the bottom of the duct module body 720 corresponding to a lower end of the first recovery duct 740. The accommodating portion communication port 721 may be provided as an opening formed at one end of the first recovery duct 740. The connection opening 711 may be provided as an opening formed at the other end of the first recovery duct 740. The accommodating portion communication port 721 is formed at the lower end of the first recovery duct 740 and may be positioned vertically below the connection opening 711. The first recovery duct 740 may be defined as a concept including a connection opening 711 and an accommodating portion communication port 721.

Cold air in the lower storage compartments 2*a* and 2*b* may pass through the connection opening 711 of the connection cover 710, and then pass through the connection part 19 and be introduced into the accommodating portion 1110 of the cooling module 1000. Or, recovery cold air in the lower storage compartments 2*a* and 2*b* may be introduced into the accommodating portion 1110 of the cooling module 1000 after sequentially passing through the connection opening 711 of the connection cover 710, the first recovery duct 740, and the accommodating portion communication port 721. Because the connection opening 711 is positioned at a front upper end of the connection cover 710 and the first recovery duct 740 and the accommodating portion communication port 721 are disposed vertically below the connection opening 711, cold air introduced into the accommodating portion 1110 may be introduced into the first cooling fan 1310 or the second cooling fan 1320 after sufficient heat exchange with the evaporator 1200 is performed.

Figure 22:
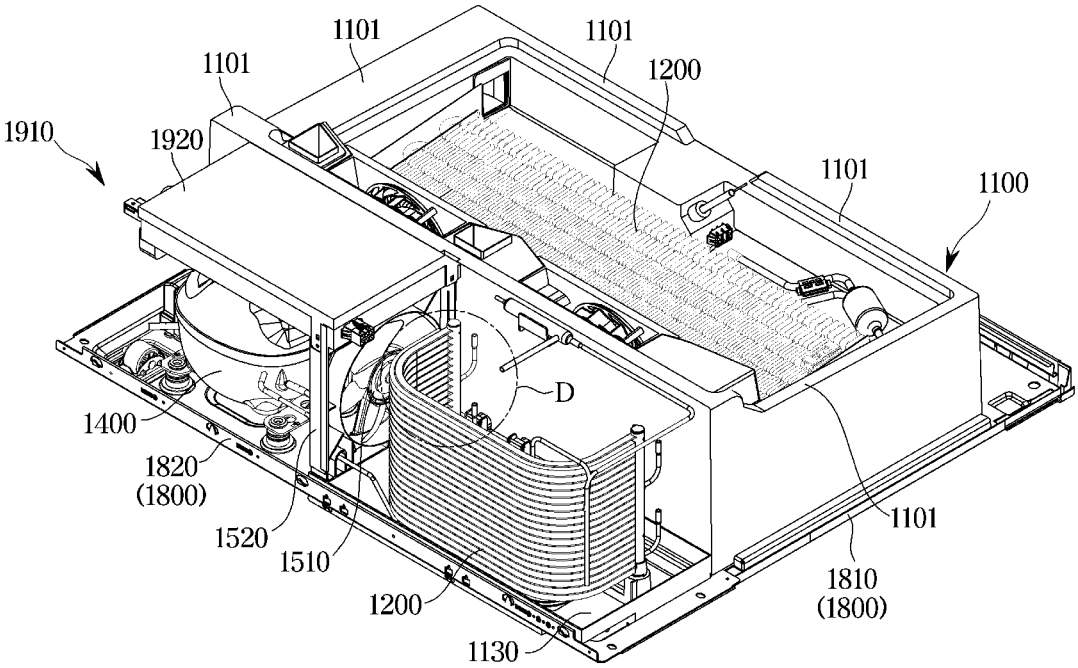
FIG. 22 is a rear perspective view of a cooling module according to another embodiment of the disclosure.
Figure 23:
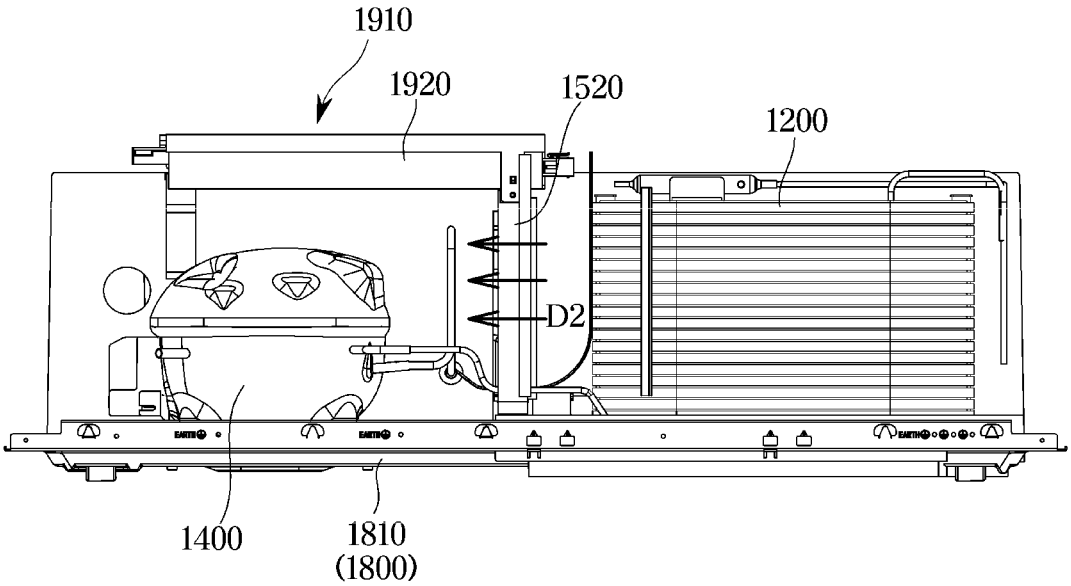
FIG. 23 illustrates the cooling module according to another embodiment of the disclosure viewed from the rear.
Figure 24:
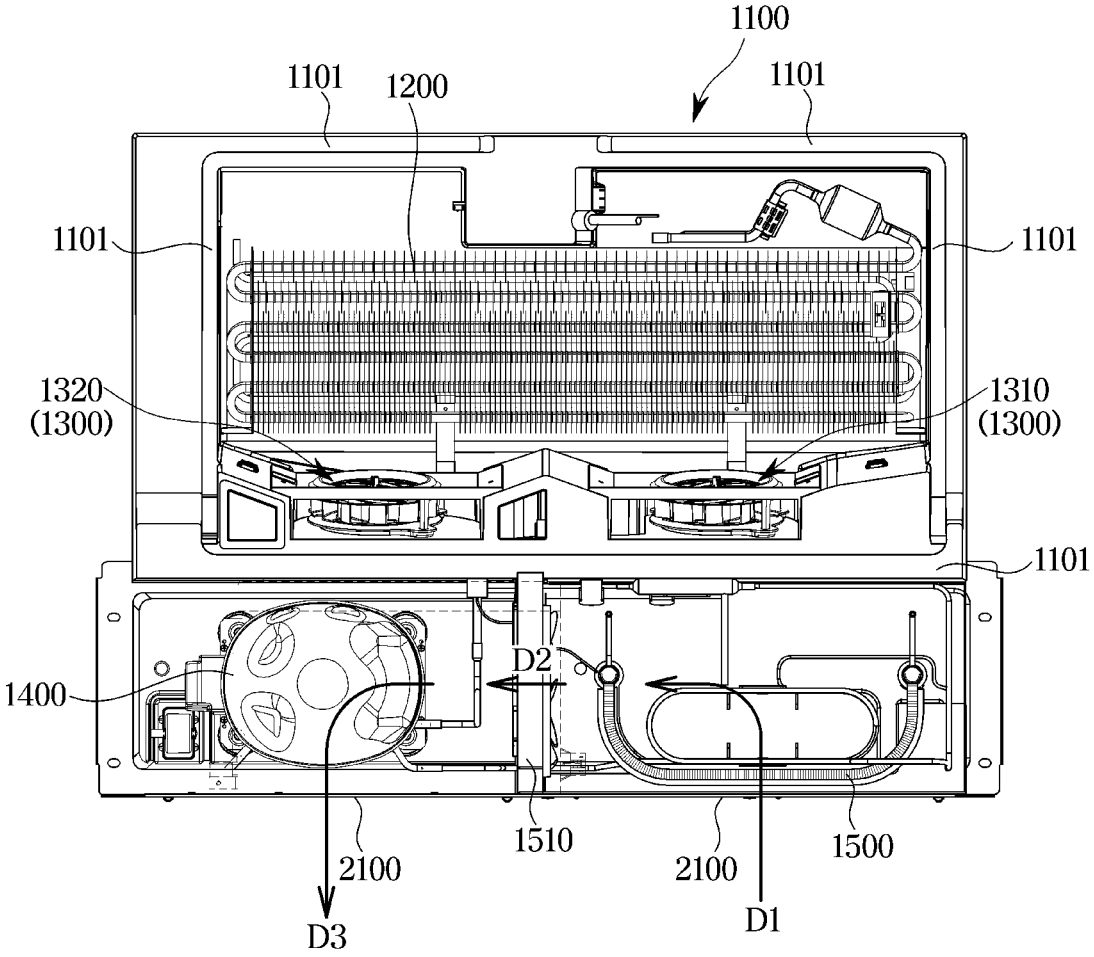
FIG. 24 illustrates the cooling module according to another embodiment of the disclosure viewed from above.
Figure 25:
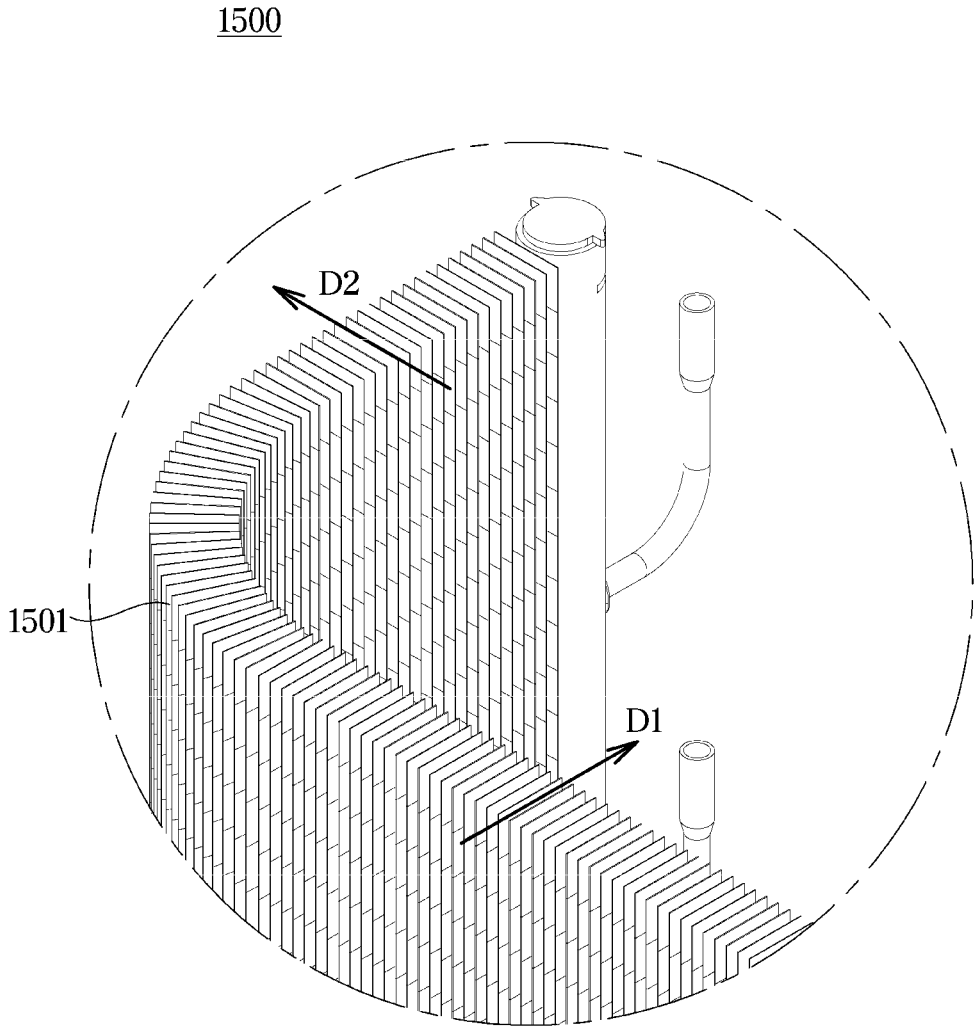
FIG. 25 is an enlarged view of a portion D in FIG. 22.

FIG. 22 is a rear perspective view of a cooling module according to another embodiment of the disclosure. FIG. 23 illustrates the cooling module according to another embodiment of the disclosure viewed from the rear. FIG. 24 illustrates the cooling module according to another embodiment of the disclosure viewed from above. FIG. 25 is an enlarged view of a portion D in FIG. 22;

Referring to FIGS. 22 to 24, an electrical module 1910 to control the cooling module 1000 may be provided in the cooling module 1000. The electrical module 1910 may change a temperature of the storage compartment 2 by controlling the cooling module 1000. The electrical module 1910 may include electrical components (not shown) and an electrical module housing 1920 in which the electrical components (not shown) are disposed therein. The electrical module housing 1920 may be provided in a substantially rectangular parallelepiped shape.

The compressor 1400 and the condenser 1500 may be disposed left and right at the rear of the module body 1100 with the condensing fan 1510 therebetween. The electrical module housing 1920 of the electrical module 1910 may be disposed above the compressor 1400 and below the outer case bottom 11*b*. The electrical module housing 1920 may be disposed between the compressor 1400 and the outer case bottom 11*b*.

Specifically, the electrical module housing 1920 may be supported by a support bracket 1102 protruding from the module body 1100 toward the compressor 1400 and an upper end of the condensing fan cover 1520. Accordingly, a cooling airflow D2 blown by the condensing fan 1510 may intensively flow to a lower portion of the electrical module housing 1920 to cool the compressor 1400. In addition, the cooling airflow D2 may simultaneously cool heat generated from the electrical components of the electrical module 1910 while flowing along the lower portion of the electrical module housing 1920.

Referring to FIG. 24, the cooling module 1000 may further include the module rear cover 2000 configured to cover the condenser 1500, the condensing fan 1510, the compressor 1400 and the electrical module 1910 and form an outer appearance of the refrigerator 1 together with a rear wall of the outer case 11. The module rear cover 2000 may include a vent hole 2100 provided in a region corresponding to the condenser 1500 or the compressor 1400.

As illustrated in FIG. 24, air outside the refrigerator 1 may flow along an airflow D1 introduced into the vent hole 2100 of the module rear cover 2000 corresponding to the condenser 1500, an airflow D2 flowing by the condensing fan 1510, and an airflow D3 flowing out to the vent hole 2100 of the module rear cover 2000 corresponding to the compressor 1400 through the compressor 1400.

The condenser 1500 may include a plurality of cooling fins 1501. The plurality of cooling fins 1501 may be arranged in a C shape including a short side adjacent to the condensing fan 1510 and a long side adjacent to the module rear cover 2000.

Each of the plurality of cooling fins 1501 may be arranged in parallel with the flow direction of the airflows D1 and D2 flowing into the condensing fan 1510 by being introduced into the vent hole 2100. The plurality of cooling fins 1501 may be arranged in parallel with the flow direction of the airflows to form an effective circulation airflow, thereby cooling the condenser 1500 and the compressor 1400 more effectively.

Figure 26:
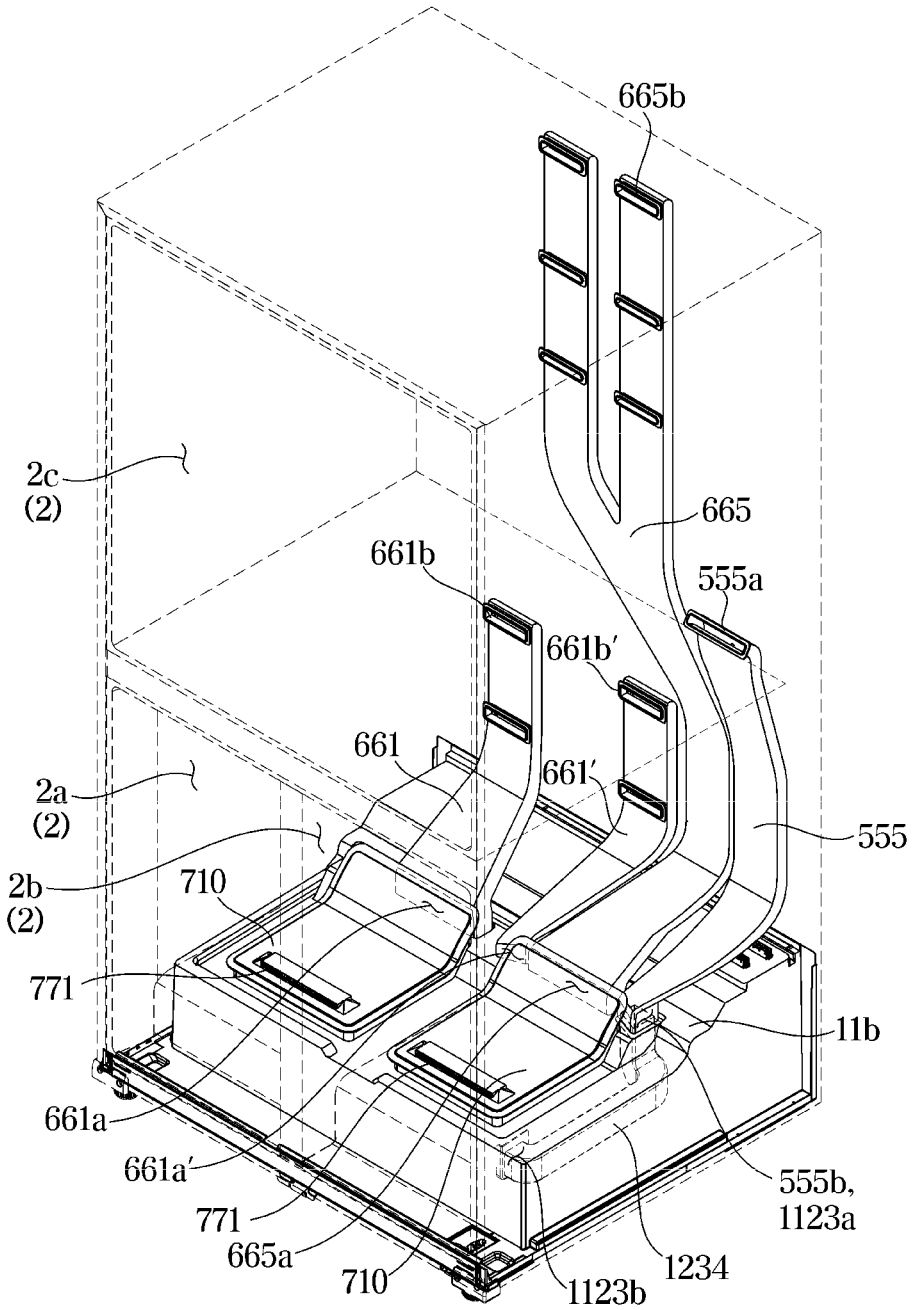
FIG. 26 is a front perspective view of a cold air duct according to another embodiment of the disclosure.
Figure 27:
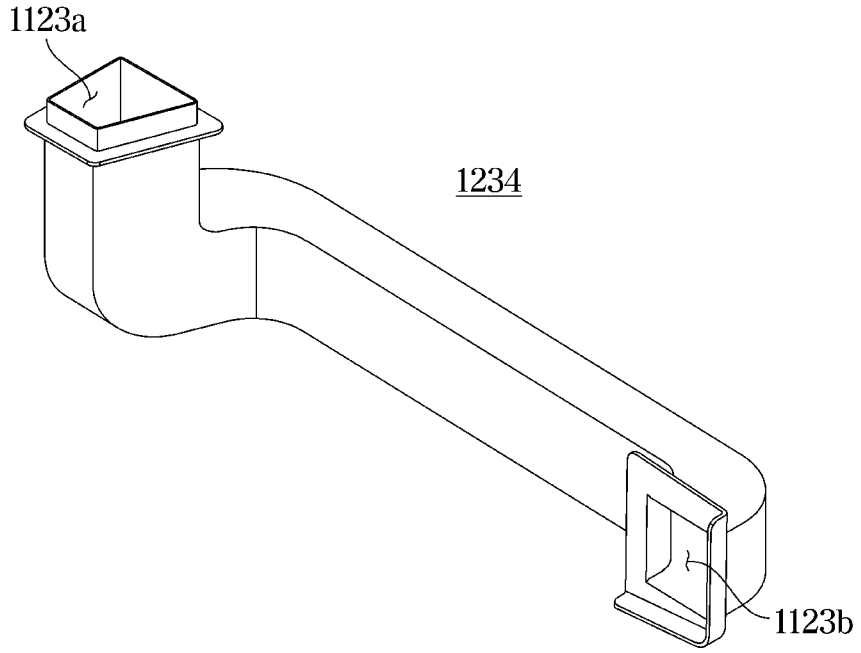
FIG. 27 is a perspective view of a bypass duct according to another embodiment of the disclosure.
Figure 28:
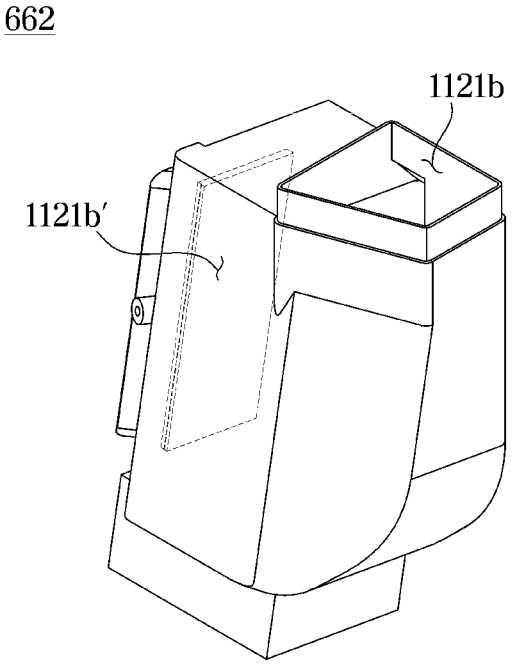
FIG. 28 is a perspective view of a damper according to another embodiment of the disclosure.

FIG. 26 is a front perspective view of a cold air duct according to another embodiment of the disclosure. FIG. 27 is a perspective view of a bypass duct according to another embodiment of the disclosure. FIG. 28 is a perspective view of a damper according to another embodiment of the disclosure.

Referring to FIGS. 11 and 26, a first supply duct 661, a second supply duct 661, a third supply duct 665, and a second recovery duct 555 according to another embodiment of the disclosure may be configured in a state of being embedded in the insulator 13 provided between the outer case 11 and the inner case 12.

The refrigerator 1 according to another embodiment of the disclosure may include the second recovery duct 555 configured to recover cold air in the storage compartment 2, specifically the third storage compartment 2*c*, which is the upper storage compartment, to the cooling module 1000, and the first supply duct 661, the second supply duct 661', and the third supply duct 665, which are configured to supply cold air generated in the cooling module 1000 to the storage compartment 2, specifically the lower storage compartments 2*a* and 2*b*.

When the cooling module 1000 is completely mounted on the cooling module mounting unit 200, a first inlet portion 661*a* of the first supply duct 661 may be in communication with the first blowing opening 1121*a* positioned at the upper end of the first cooling fan seating portion 1121 to be supplied with cold air. Specifically, the first inlet portion 661*a* of the first supply duct 661 may be connected to the first cold air inlet 221 formed on the outer case bottom 11*b*. When the cooling module 1000 is completely mounted on the cooling module mounting unit 200, the first blowing opening 1121*a* of the module body 1100 is in communication with the first cold air inlet 221 in a state of being in close contact with each other, and thus the first blowing opening 1121*a* may also be in communication with the first inlet portion 661*a* of the first supply duct 661. Cold air introduced into the first inlet portion 661*a* of the first supply duct 661 may be supplied to the first storage compartment 2*a* through a first discharge portion 661*b* of the first supply duct 661.

When the cooling module 1000 is completely mounted on the cooling module mounting unit 200, a second inlet portion 661*a*' of the second supply duct 661' may be in communication with the second blowing opening 1121*b* to be supplied with cold air. Specifically, the second inlet portion 661*a*' of the second supply duct 661' may be connected to the second cold air inlet 221' formed on the outer case bottom 11*b*. When the cooling module 1000 is completely mounted on the cooling module mounting unit 200, the second blowing opening 1121*b* of the module body 1100 is in communication with the second cold air inlet 221' in a state of being in close contact with each other, and thus the second blowing opening 1121*b* may also be in communication with the second inlet portion 661*a*' of the second supply duct 661'. Cold air introduced into the second inlet portion 661*a*' of the second supply duct 661' may be supplied to the second storage compartment 2*b* through a second discharge portion 661*b*' of the second supply duct 661'.

When the cooling module 1000 is completely mounted on the cooling module mounting unit 200, a third inlet portion 665*a* of the third supply duct 665 may be in communication with the third blowing opening 1122*a* to be supplied with cold air. Specifically, the third inlet portion 665*a* of the third supply duct 665 may be connected to the third cold air inlet 222 formed on the outer case bottom 11*b*. When the cooling module 1000 is completely mounted on the cooling module mounting unit 200, the third blowing opening 1122*a* of the module body 1100 is in communication with the third cold air inlet 222 in a state of being in close contact with each other, and thus the third blowing opening 1122*a* may also be in communication with the third inlet portion 665*a* of the third supply duct 665. Cold air introduced into the third inlet portion 6651*a* of the third supply duct 665 may be supplied to the third storage compartment 2*c* through a third discharge portion 665*b* of the third supply duct 665.

Cold air in the lower storage compartments 2*a* and 2*b*, that is the first storage compartment 2*a* and the second storage compartment 2*b*, may pass through the connection opening 711 of the connection cover 710 and then may pass through the connection part 19 and introduced into the accommodating portion 1110 of the cooling module 1000. Or, recovery cold air in the lower storage compartments 2*a* and 2*b* may sequentially pass through the connection opening 711 of the connection cover 710, the first recovery duct 740, and the accommodating portion communication port 721 and then may be introduced into the accommodating portion 1110 of the cooling module 1000. Because the connection opening 711 is positioned at the front upper end of the connection cover 710 and the first recovery duct 740 and the accommodating portion communication port 721 are disposed vertically below the connection opening 711, cold air introduced into the accommodating portion 1110 may be introduced into the first cooling fan 1310 or the second cooling fan 1320 after sufficient heat exchange with the evaporator 1200 is performed.

Cold air in the upper storage compartment 2*c*, that is, the third storage compartment 2*c* may be introduced into a recovery inlet portion 555*a* formed on one end of the second recovery duct 555 and pass through the second recovery duct 555, and then may flow to a recovery discharge portion 555*b* formed on the other end of the second recovery duct 555. The recovery inlet portion 555*a* may be disposed on one side of a lower edge of the third storage compartment 2*c*. The recovery discharge portion 555*b* may be connected to the cold air outlet 223 formed on the outer case bottom 11*b*. When the cooling module 1000 is completely mounted on the cooling module mounting unit 200, the first recovery port 1123*a* of the module body 1100 is in communication with the cold air outlet 223 in a state of being in close contact with each other, and thus the first recovery port 1123*a* may also be in communication with the recovery discharge portion 555*b* of the second recovery duct 555.

Referring to FIGS. 26 and 27, cold air discharged to the recovery discharge portion 555*b* of the second recovery duct 555 does not directly flow into the accommodating portion 1110, but may flow by bypassing a bypass duct 1234. The first recovery port 1123*a* may be positioned at one end of the bypass duct 1234. At the other end of the bypass duct 1234, a second recovery port 1123*b* formed on a portion of the module body 1100 corresponding to the front of an inner region of the accommodating portion 1110 may be positioned. Similar to the connection opening 711 formed on the upper front of the connection cover 710, the second recovery port 23*b* [A3] allows cold air to flow into the front of the inner region of the accommodating portion 1110 so that the cold air may be sufficiently heat exchanged with the evaporator 1200.

Referring to FIGS. 13, 14, and 28, the refrigerator 1 according to another embodiment of the disclosure may further include a damper 662.

The damper 662 may be disposed between the first cooling fan seating portion 1121 and the second cooling fan seating portion 1122. An auxiliary opening 1121*b*' communicating with the second blowing opening 1121*b* may be formed in a region of the partition wall of the module body 1100 corresponding to a side surface of the first cooling fan seating portion 1121. One side of the damper 662 may be in communication with the auxiliary opening 1121*bc*, and the other side of the damper 662 may be in communication with the second blowing opening 1121*b*. Cold air introduced into the auxiliary opening 1121*b*' by the opening and closing operations of the damper 662 may be selectively supplied to the second storage compartment 2*b*. The damper 662 may be configured such that an opening degree thereof may be adjusted in order to adjust the amount of cold air distributed between the first supply duct 661 and the second supply duct 662.

As is apparent from the above, in a refrigerator according to the disclosure, a cooling module configured to generate and supply cold air is detachably mounted in a cabinet, so that a cold air supply system can be easily maintained.

In the refrigerator according to the disclosure, cold air in the cooling module is circulated through a cold air duct embedded in an insulator, so that the loss of cold air in a storage compartment can be reduced when the cooling module is mounted or removed.

In the refrigerator according to the disclosure, a defrost water collection tub of an evaporator is integrally installed in a module body, so that a manufacturing cost of the cooling module for individual installation of the defrost water collection tub can be reduced and an installation structure can be simplified to improve productivity. In addition, water vapor is prevented from flowing back into the evaporator by the heat of a condenser by a drain cap connected to a drain hole, so that condensation on the evaporator can be prevented.

In the refrigerator according to the disclosure, the evaporator is disposed in the cooling module in a lying state, so that a defrost time and energy consumption during the defrosting of the evaporator can be reduced.

While the disclosure has been particularly described with reference to exemplary embodiments, it should be understood by those of skilled in the art that various changes in form and details may be made without departing from the spirit and scope of the disclosure.

What is claimed is:

1. A refrigerator comprising:

a cabinet comprising an inner case forming a storage compartment, an outer case, and an insulator provided between the inner case and the outer case;

a cooling module mounting unit provided at a lower portion of the cabinet;

a cooling module comprising a module body in which one or more of an evaporator, a condenser, a compressor, and a cooling fan are installed and having an accommodating portion to accommodate the evaporator horizontally herein;

a connection part comprising an outer case bottom opening formed at a bottom of the outer case and corresponding to the accommodating portion, and an inner case bottom opening formed at a bottom of the inner case and corresponding to the outer case bottom opening, the inner case bottom opening and the outer case bottom opening being arranged vertically;

an access neck formed along a circumference of the outer case bottom opening and protruding from the bottom of the outer case toward the inner case bottom opening;

a neck flange formed at one end of the access neck to be in contact with the bottom of the inner case;

a connection cover configured to open or close the inner case bottom opening; and wherein the connection part is formed inside the access neck, and wherein the cooling module is in communication with the storage compartment through the connection part when mounted on the cooling module mounting unit.

2. The refrigerator according to claim 1, wherein the connection cover comprises a connection opening through which the connection part is in communication with the storage compartment in a state in which the connection cover closes the inner case bottom opening.

3. The refrigerator according to claim 1, further comprising a duct module seated on the connection part and having a shape corresponding to the connection part.

4. The refrigerator according to claim 3, wherein the duct module comprises:

a duct module body seated on the connection part;

an insulator filled in the duct module body; and a cold air recovery duct passing through the duct module body and the insulator, the connection cover covers an upper end of the insulator and is coupled to an upper end of the duct module body, and an opening formed at one end of the cold air recovery duct is in communication with the accommodating portion and an opening formed at the other end of the cold air recovery duct is in communication with the connection opening of the connection cover.

5. The refrigerator according to claim 4, wherein the connection cover is provided to be caught on the bottom of the inner case positioned at an edge of the inner case bottom opening.

6. The refrigerator according to claim 4, wherein an area in which an upper edge of the connection cover is formed is larger than an area in which an edge of the inner case bottom opening is formed.

7. The refrigerator according to claim 1, wherein the module body further comprises a protrusion formed along an upper edge of the module body.

8. The refrigerator according to claim 7, wherein the bottom of the outer case comprises a depression formed on a portion of the bottom of the outer case facing the cooling module mounting unit and corresponding to a shape of the protrusion.

9. The refrigerator according to claim 8, wherein when the cooling module is mounted on the cooling module mounting unit, the protrusion and the depression are in close contact with each other to block the outflow of cold air near the upper edge of the module body.

10. The refrigerator according to claim 1, wherein the cooling module further comprises a collecting portion in which condensed water is collected and the condenser is disposed, the collecting portion being arranged adjacent to the accommodating portion in a front-rear direction of the module body with a partition wall forming the accommodating portion therebetween, and the accommodating portion and the collecting portion are in communication with each other through a drain hole formed on the accommodating portion and a drain pipe connected to the drain hole and passing through the partition wall, and the drain pipe and a bottom of the accommodating portion are provided to be inclined downward toward the collecting portion.

11. The refrigerator according to claim 10, wherein the cooling module further comprises a drain cap rotatably coupled to one end of the drain pipe, and the drain cap is configured to open and close the one end of the drain pipe by an own weight thereof.

12. The refrigerator according to claim 1, wherein the cooling module further comprises a controller configured to control the cooling module, the compressor and the condenser are arranged left and right at the rear of the module body with a condensing fan therebetween, and a housing which accommodates the controller, is disposed above the compressor and below the bottom of the outer case.

13. The refrigerator according to claim 12, wherein the cooling module further comprises a support bracket protruding from the module body toward the compressor, and a bottom of the housing is supported by an upper end of the condensing fan and the support bracket.

14. The refrigerator according to claim 12, wherein the cooling module further comprises a module rear cover configured to cover the condenser, the condensing fan, the compressor, and the electrical module and forming an outer appearance of the refrigerator together with a rear wall of the outer case, the module rear cover comprises a vent hole in a region corresponding to the condenser or the compressor, the condenser comprises a plurality of cooling fins, and each of the plurality of cooling fins is arranged in parallel with a flow direction of an airflow flowing into the condensing fan by being introduced into the vent hole.

15. The refrigerator according to claim 14, wherein the plurality of cooling fins is arranged in a C shape including a short side adjacent to the condensing fan and a long side adjacent to the module rear cover.

* * * * *